United States Patent [19]

Simmons et al.

[11] Patent Number: 4,861,239

[45] Date of Patent: Aug. 29, 1989

[54] HIGH EFFICIENCY PUMP METHOD AND APPARATUS WITH HYDRAULIC ACTUATION

[75] Inventors: Eugene D. Simmons; Graham C. Thomson, III; Richard J. Reynaud, all of Roswell, N. Mex.

[73] Assignee: Rent, Ltd., Sunnyvale, Calif.

[21] Appl. No.: 205,588

[22] Filed: Jun. 13, 1988

Related U.S. Application Data

[63] Continuation of Ser. No. 854,374, Apr. 21, 1986, abandoned.

[51] Int. Cl.[4] ..... F04B 47/08

[52] U.S. Cl. ..... 417/383; 417/490

[58] Field of Search ..... 417/383, 385, 386, 387, 417/388, 390, 401, 403; 91/318

[56] References Cited

U.S. PATENT DOCUMENTS

| | | | |
|---|---|---|---|
| 731,241 | 6/1903 | Steiner | 417/540 X |
| 1,802,790 | 4/1931 | Squires | 417/386 |
| 1,885,820 | 11/1932 | Gothard | 417/383 |
| 2,277,306 | 3/1942 | Coffey | 417/383 |
| 2,319,749 | 5/1943 | Salnikov | 417/392 |
| 2,429,947 | 10/1947 | Rose | 417/388 |
| 2,870,717 | 1/1959 | Dube et al. | 417/390 |
| 2,942,552 | 6/1960 | Wayt | 417/401 |
| 3,123,007 | 3/1964 | Orr | 417/383 |
| 3,276,381 | 10/1966 | Harklau | 417/395 |
| 4,551,075 | 11/1985 | Canalizo | 417/383 |
| 4,611,974 | 9/1986 | Holland | 417/388 |

*Primary Examiner*—Leonard E. Smith
*Attorney, Agent, or Firm*—Paul Hentzel

[57] ABSTRACT

A method and apparatus for pumping water, oil, or other production fluid up a production tube from a well or the like to achieve greater efficiency as compared to conventional pumpjacks. A hydraulic acutator unit with its own hydraulic fluid incorporates pressure sensing valves to move a hydraulic piston through a power stroke and a resetting stroke. A power transmission tube having its own power fluid transfers pressure from the hydraulic actuator to a downhole piston assembly to pump the production fluid directly up the production tube during a power stroke. The static head of the production fluid in the production tube resets the downhole piston assembly during the resetting stroke. The pressure sensing valves enable the hydraulic piston the extend its power stroke a sufficient distance to pressurize the power transmission fluid and move the downhole piston assembly through its entire production stroke independent of the compressibility of the power transmission fluid. Another embodiment provides for two power tubes respectively coupled through pulser units to opposite ends of the hydraulic piston to alternately pressurize the power tubes thus making each stroke of the hydraulic piston a combined power/resetting stroke. Each of the embodiments is applicable for single and multiple well installation.

25 Claims, 20 Drawing Sheets

FIG 13

| Depth ft | Flow Rate BPD | Invention HP | Pump Jack HP | Energy Savings % |
|---|---|---|---|---|
| 1000 | 100 | 1.00 | 1.96 | 49.0 |
| | 200 | 2.17 | 3.92 | 44.6 |
| | 300 | 3.79 | 5.88 | 35.5 |
| | 400 | 5.83 | 7.84 | 25.6 |
| 2000 | 100 | 2.03 | 3.92 | 48.2 |
| | 200 | 4.48 | 7.84 | 42.9 |
| | 300 | 7.71 | 11.76 | 34.4 |
| | 400 | 12.10 | 15.69 | 22.9 |
| 3000 | 100 | 3.16 | 5.88 | 46.3 |
| | 200 | 6.92 | 11.76 | 41.2 |
| | 300 | 11.36 | 17.65 | 35.6 |
| | 400 | 17.63 | 23.53 | 25.1 |
| 4000 | 100 | 4.66 | 7.84 | 40.6 |
| | 200 | 11.28 | 15.69 | 28.1 |
| | 300 | 17.63 | 23.53 | 25.1 |
| | 400 | 25.10 | 31.37 | 20.0 |
| 5000 | 100 | 6.35 | 9.80 | 35.2 |
| | 200 | 15.57 | 19.61 | 20.6 |
| | 300 | 24.29 | 29.41 | 17.4 |
| | 400 | 34.00 | 39.22 | 13.3 |

POWER STROKE
RESETTING STROKE
PSI
1750
1500
1250
1000
750
500
250
0
2
4
6

RESETTING STROKE
POWER STROKE
Time in Seconds
PSI
800
600
400
200
0
2
4
6
8
10
12
14
16
18

HIGH EFFICIENCY PUMP METHOD AND APPARATUS WITH HYDRAULIC ACTUATION

This application is a continuation of application Ser. No. 854,374 filed on Apr. 21, 1986, now abandoned.

BACKGROUND OF THE INVENTION

This invention relates generally to the pumping of fluid such as water or oil from a well or formation to a collection location, and more particularly, to a downhole production unit which is coupled to a surface controller solely through a hydraulically activated power tube.

Many different types of pumps exist for pumping fluids from a remote location such as the bottom of a water well or oil well to a collection location such as a surface mounted reservoir tank. Efficiency is difficult to achieve because the fluid formation in a well may be quite deep in the ground, requiring the pump to consume excessive energy to lift the fluid from the formation to the surface.

One prior art pump for use in the water and oil well environment is the common pump jack. A frame is mounted at the surface near the well and mounts a pivotal rocker arm. One end of the rocker arm supports the sucker rods which extend into the well to the fluid formation. Counterweights at the other end of the rocker arm balance the arm. A pumping unit is mounted at the lower end of the sucker rod in the well. A motor is then used to rock the arm about its pivotal axis, causing a reciprocating motion in the pumping unit downhole to lift fluid to the surface. While the pump jack has proven generally satisfactory for many years, it is a massive unit and can often be two or three stories high. This causes the pump jack to be expensive, inefficient, and difficult to move between wells. Also, the mechanical interconnection to the downhole unit is often subject to breakdown. Moreover, the leakage of oil from the production line and lubricants at the mechanical interconnections at pump jack wellheads tends to permanently contaminate the adjacent environment.

There are other deficiencies in the pumpjack which create disadvantages. A pumpjack suitable for a small volume well and/or a shallow well cannot be used for a medium volume well and/or a deep well, and vice-versa. Thus a whole series of different capacity/depth units must be made available. Another disadvantage is the need for straight vertical alignment of the downhole unit to avoid mechanical wear during the reciprocation cycle. Finally, there are severe problems of gas-locking when the well formation fluid has gaseous material intermixed with the formation liquids.

Some of the mechanical problems of the pumpjack structure are minimized by the hydraulic pump units which transfer power to the downhole unit through hydraulic pressure. These prior art hydraulic units are nevertheless very expensive, unusually complicated and inefficient to operate, and have still not solved the gas-lock problem and require extensive maintenance. Moreover, many of these hydraulically actuated pumps do not seek to maintain the hydraulic fluid and/or the power transfer fluid separate and apart from each other or from the production fluid. Also, they often use electrical components as part of the pressure control system, and may use complicated valving systems in the downhole unit.

Also, some of the prior art pumps use a downhole spring unit for providing the production force. Such mechanical device is often subject to malfunction, breakdown and/or loss of resiliency. Moreover, the return force of a spring is not constant.

Finally, while some of the aforementioned types of prior art pumps will function to some extent under optimum conditions, they lack consistent performance when typical changes occur such as change of compressibility of the column of power transfer fluid; presence of sludge, gaseous matter and/or other non-liquid additives in the production fluid; intrusion of contaminants into the hydraulic or power transfer fluid; and fluid leakages from the hydraulic or power transfer cylinders.

In summary, most of the prior art pumping units are special purpose devices which require excessive capital expenditures to purchase and install, and work only under limited conditions with respect to ranges of production (BPD), well depths, types of fluid mixtures pumped (e.g., no sludge, no gaseous mixtures), above-ground space requirements, power consumption, removability for servicing or replacement of parts, and field maintenance versus shop maintenance.

Listed below are various prior art patents which have tried unsuccessfully to provide a surface power unit in combination with a downhole production unit which efficiently uses hydraulic pressure and/or static head pressure to transfer formation fluid from a well to a collection point at the surface, without all the mechanical downhole interconnections of a pump jack: U.S. Pat. No: 436,708 issued Sept. 16, 1880; U.S. Pat. No: 376,382 issued Jan. 10, 1888; U.S. Pat. No: 1,503,602 issued Aug. 5, 1924; U.S. Pat. No: 1,616,773 issued Feb. 8, 1927; U.S. Pat. No: 1,630,902 issued May 31, 1927; U.S. Pat. No: 1,761,081 issued June 3, 1930; U.S. Pat. No: 1,981,288 issued Nov. 20, 1934; U.S. Pat. No: 2,058,455 issued Oct. 27, 1936; U.S. Pat. No: 2,122,823 issued July 5, 1938; U.S. Pat. No: 2,127,168 issued Aug. 16, 1938; U.S. Pat. No: 2,147,924 issued Feb. 21, 1939; U.S. Pat. No: 2,220,334 issued Nov. 5, 1940; U.S. Pat. No: 2,340,943 issued Feb. 8, 1944; U.S. Pat. No: 2,362,777 issued Nov. 14, 1944; U.S. Pat. No: 2,478,410 issued Aug. 9, 1949; U.S. Pat. No: 2,555,613 issued June 5, 1951; U.S. Pat. No: 2,527,184 issued Oct. 24, 1950; U.S. Pat. No: 2,917,000 issued Dec. 15, 1959; U.S. Pat. No: 2,942,552 issued June 28, 1960; U.S. Pat. No: 3,015,280 issued Jan. 2, 1962; U.S. Pat. No: 3,030,893 issued Apr. 24, 1962; U.S. Pat. No: 3,103,175 issued Sept. 10, 1963; U.S. Pat. No: 3,123,007 issued Mar. 3, 1964; U.S. Pat. No: 3,374,746 issued Mar. 26, 1968; U.S. Pat. No: 3,804,557 issued Apr. 16, 1974; U.S. Pat. No: 3,589,838 issued June 29, 1971; U.S. Pat. No: 4,026,661 issued May 31, 1977; U.S. Pat. No: 2,490,118 issued Dec. 6, 1949; U.S. Pat. No: 4,028,013 issued June 7, 1977; U.S. Pat. No: 4,031,385 issued Mar. 22, 1977; U.S. Pat. No: 4,285,422 issued Aug. 25, 1981; U.S. Pat. No: 4,295,799 issued Oct. 20, 1981; U.S. Pat. No: 4,381,177 issued Apr. 26, 1983; U.S. Pat. No: 4,390,326 issued June 28, 1983; U.S. Pat. No: 4,403,919 issued Sept. 13, 1983; U.S. Pat. No: 4,449,892 issued May 22, 1984.

A need therefore exists for an improved pumping unit which incorporates the benefits of downhole fluid power transmission from a surface powered pump while avoiding the prior art disadvantages of complexity, size, weight, breakdowns, inefficiency, high maintenance costs, and malfunctions due to gaseous materials and other contaminants in the various fluid systems of the apparatus.

The most recent well pumping apparatus with which we are familiar and which incorporates a column of power transfer fluid located in the well casing is disclosed in Patent Application Ser. No: 662,963 filed Oct. 19, 1984, now U.S. Pat. No. 4,616,981 entitled IMPROVED PUMPING APPARATUS WITH A DOWN-HOLE SPRING LOADED PISTON ACTUATED BY FLUID PRESSURE. Nevertheless, the invention of the present application eliminates the need for a spring in the downhole unit and constitutes a substantive and unique improvement which provides efficiency, reliability, and versatility which to some extent were found to be lacking in the pumping apparatus of such previously filed application.

It is an object of the present invention to overcome the aforesaid deficiencies of the prior art pumps, and to provide an improved method and apparatus for efficiently pumping oil, water or other fluid from a well formation up to the surface, without any mechanical interconnection between the surface controller unit and the downhole production unit. A related object is to eliminate the need for any mechanical energy device like a spring in the downhole unit.

Another object of the invention is to provide an improved pump method and apparatus which employs three separate fluid systems, namely, a hydraulic fluid system for controlling the movement of a hydraulic piston, a power fluid system for transferring the pressure generated by the hydraulic piston to the downhole piston assembly, and a production fluid system for carrying the formation fluid up the well to an outlet or storage tank. A related object is to isolate the hydraulic fluid system from the power fluid system and similarly to isolate the power fluid systems from the production fluid systems during normal operation of the invention.

Still another object of the invention is to transfer production fluid up to the surface during a power stroke of the hydraulic piston. A related object is to provide a high efficiency embodiment which utilizes the static head of the production fluid column to reset the downhole piston assembly and which utilizes any additional resetting force to assist in moving the hydraulic piston through its return stroke.

Yet another object of the invention is to provide pressure sensing valves in the surface hydraulic actuator unit so that the hydraulic piston does not start its return stroke until the downhole piston assembly has completed the full length of its production stroke, to avoid incomplete production inefficiency due to compressability of the power transmission fluid.

Still a further object of the invention is to provide an alternate embodiment incorporating two power tubes each having a pulser piston respectively coupled to opposite ends of the hydraulic piston. A related object is to connect the power tubes to two or more wells to increase the efficiency of multiple well installations, or alternatively to connect both power tubes to a single well.

It is a further object of the invention to provide a relatively lightweight pumping unit which can be installed by one person, which operates quietly and efficiently at a production rate that can be easily varied, and which can be mounted at the top of a well in a low profile or underground location, and which employs standard component parts which can be easily repaired or replaced during operation over many years. A related object is to eliminate the mechanical devices which have been typically used in prior art pumps such as stuffing boxes, belts, pulleys, polish rods, springs, electric switches, and the like which have short production life expectancies and which utilize excessive energy.

Another object is to provide a pumping apparatus which allows the rate of flow from the well production tube to be increased or decreased without having to reinstall a new set of pumping equipment.

A further object is to provide a pump apparatus where the size of the surface unit does not significantly increase even though the depth and/or production volume of the well production unit is increased. A related object is to provide a full range of ratios beginning with less than two-to-one based on comparing the linear displacement of the downhole unit with the corresponding linear displacement of the pulser piston in the hydraulic actuator.

Yet another object is to provide a method of well pumping which allows the amount of the return force transmitted in the counterbalance chamber(s) of the downhole unit to be easily modified as needed for each individual well installation. A related object is to provide a priming line in the hydraulic actuator unit for supplying hydraulic fluid to the hydraulic cylinder in instances where an excess of return force in the downhole counterbalance chambers speeds up the return stroke of the hydraulic piston during the resetting mode.

A further object is to provide variations in the design of the downhole pump assembly in order to meet diverse environmental conditions, including three piston units (power piston, counterbalance piston(s), and production piston), two piston static head units (combined power/production piston, counterbalance piston), two piston dual power tube units (power piston, dual production piston), and multiple piston units (power piston, one or more single/dual production pistons.

A still further object is to eliminate electrical components so that all control valves in the hydraulic actuator are pressure activated. A related object is to minimize electrical energy consumption by having a low horespower motor for the hydraulic pump as the only electrical component in the system.

These and other objects of the invention will become evident to those skilled in the art based on the exemplary embodiments of the invention shown in the attached drawings and described in detail hereinafter.

IN THE DRAWINGS

FIG. 13 is a table showing the estimated energy savings obtained from a well installation using the embodiment of FIG. 12;

DETAILED DESCRIPTION OF THE EMBODIMENTS

Figure 1:
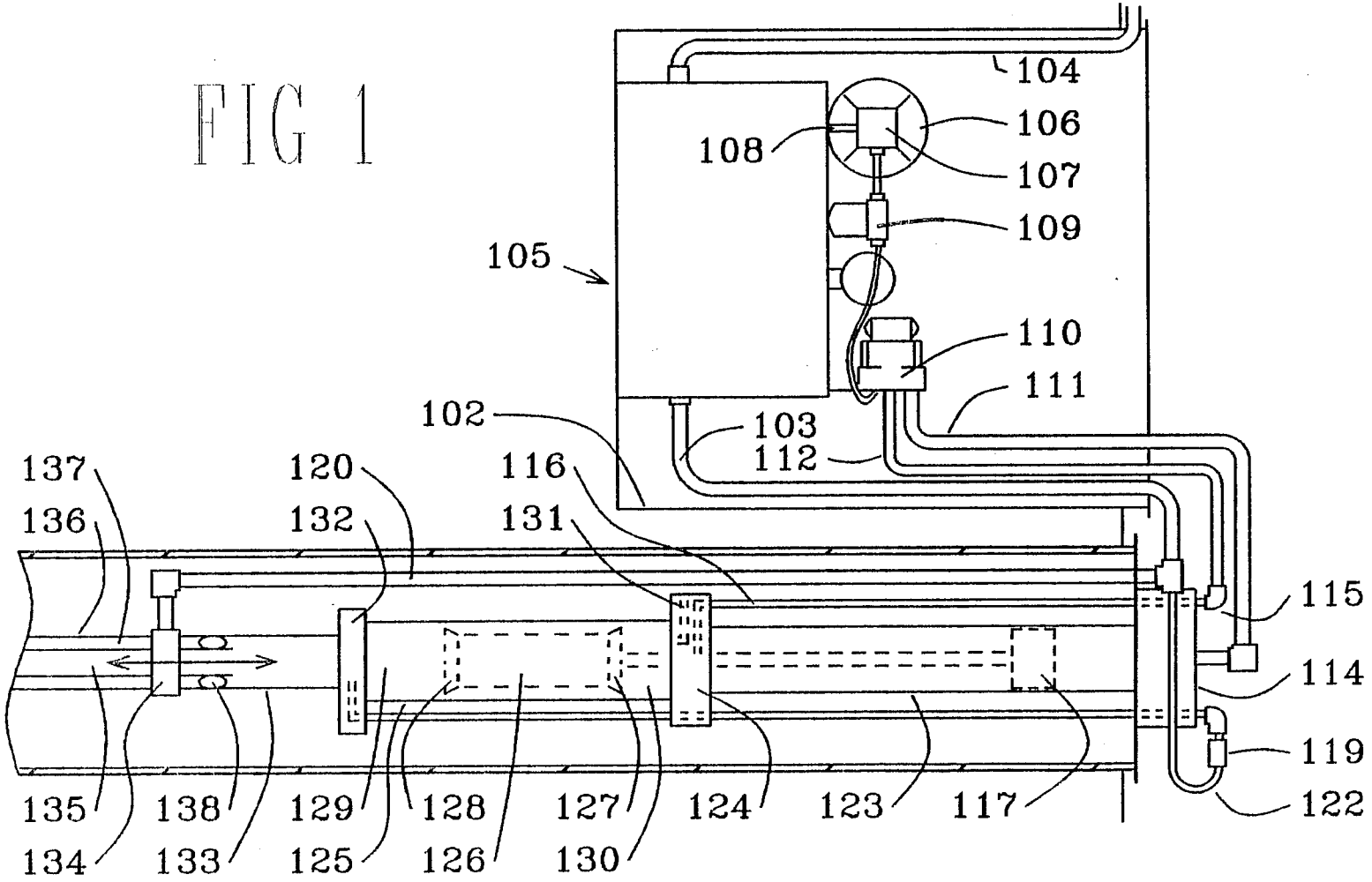
FIG. 1 shows a first embodiment of a hydraulic control unit incorporating a separately located hydraulic actuator unit coupled to a pulser displacement unit vertically mounted inside a well casing.

Generally speaking the pumping apparatus and method is employed in a conventional well to lift liquid from a subterranean formation to the surface for storage, distribution, drainage or other disposition or processing. The liquid can be water or oil or any other fluid mixture to be pumped from one location to another. In reality the liquid in a subterranean formation is often a combination of water and oil which is usually intermixed with gaseous material to provide a non-homogeneous fluid. Of course, the method and apparatus of the invention are applicable for uses other than conventional wells, such as where any liquid or fluid is moved from a source to a collection point.

In the single power tube version of the invention, a number of different designs of the multipiston assembly can be employed downhole without making any significant structural changes in the hydraulic actuator unit and the pulser displacement cylinder which are both located near the top of the well. In one downhole piston assembly, three pistons reciprocate as a unit through a power stroke and a resetting stroke. The top piston divides its chamber into an upper power compartment and a lower counterbalance compartment. The middle piston has a lower counterbalance compartment, and the bottom piston has a lower production compartment, with both the middle and bottom pistons vented through their upper compartments into the well formation. In another downhole piston assembly, two pistons reciprocate as a unit through a power stroke and a resetting stroke. The top piston divides its chamber into an upper power compartment and a lower production compartment. The bottom piston divides its chamber into an upper storage compartment for formation fluid en route to the production compartment and a lower counterbalance compartment.

In the dual power tube version, the top piston has two power compartments and the lower piston(s) each have their own production compartments above and/or below the piston.

As a result of experimental testing, four different versions of the hydraulic actuator unit and pulser displacement cylinder have been conceived in order to implement the advantages of the invention. In a first preferred embodiment, an existing wellhead is used as both the outlet for the production flow of fluid as well as a conduit for transferring pressure through a liquid column to a downhole piston assembly unit. The structure and location of the hydraulic reservoir, hydraulic vane pump/electrical motor combination, and the cylinder for housing the hydraulic piston and pulser piston are designed for taking up very little space adjacent the wellhead as well as keeping a low physical profile next to the ground. In this embodiment, a single horizontal cylinder is divided into a first chamber in which the hydraulic piston reciprocates and a second chamber in which the pulser piston reciprocates. Hydraulic supply/exhaust lines are connected at opposite ends of the hydraulic cylinder portion, while a remote end of the pulser piston cylinder portion is connected through a right-angle coupling at the top of the power tube. A first auxiliary supply line is connected between the interior end of the hydraulic piston portion and the hydraulic tank for providing continuous priming as needed during a resetting stroke of the hydraulic piston. A connecting shaft cases the smaller-diameter hydraulic piston at one end and the larger-diameter pulser piston at the other so that both pistons reciprocate as a unit. Of course, it is understood that the actual diameters as well as the relative piston diameters can be designed to fit varied well conditions, such that the hydraulic piston and its relative cylinder chamber can be the same diameter or greater diameter than the pulser piston and its associated cylinder chamber.

The production outlet line is connected at the wellhead to the annular space between the well casing and the power tube located in the center of the well casing. A second auxiliary supply line interconnects the production line and the power tube to provide replacement fluid for the power tube as needed during the resetting stroke of the pistons. The production line proceeds through the hydraulic fluid reservoir and a heat exchanger within the reservoir before going to its ultimate collection point.

All of the necessary valve control components are mounted on one end of the hydraulic reservoir tank, while the hydraulic vane pump/electrical motor combination is attached on top of the hydraulic reservoir tank. The cylinder casing for the hydraulic and pulser pistons is held in position from a bracket on the other end of the hydraulic tank. Thus, any installation or maintenance or replacement or trouble-shooting can be easily accomplished by one person without any heavy equipment or specialized tools. A pressure gauge on top of the power tube provides immediate indication of the satisfactory operation of the hydraulic actuator unit and the pulser displacement unit.

In a second preferred version of the invention, the cylinder holding the hydraulic and pulser pistons is inserted in vertical position down into the well casing below the wellhead, so that the only components on top of the wellhead are a mounted end plate for the piston cylinder, the production line, the two hydraulic supply/exhaust lines, and the auxiliary supply lines.

The hydraulic reservoir tank is located below the ground under a plexiglass cover, with the control valve and the electric motor/vane pump combination mounted on top of the tank. Thus, the production line comes out of the wellhead and down into the heat exchanger cylinders within the tank and out the tank and back up to its above-ground destination.

In a third earlier version of the invention, the pulser displacement cylinder which carries the hydraulic piston and the pulser piston is mounted directly above the wellhead in vertical alignment therewith. The hydraulic reservoir tank is positioned on the ground adjacent the wellhead, with the vane pump/electric motor and the various control valve components mounted on top of the tank.

In a fourth high efficiency version of the invention, a doubleacting hydraulic cylinder has separate pulser piston cylinders at each end so that both strokes of the hydraulic piston constitute power strokes. Since each pulser piston cylinder has its own power tube, the hydraulic reservoir tank is located midway between the wells being pumped with a single set of the usual hydraulic pump/electric motor unit and related control valve components suitably mounted on the hydraulic tank. Of course, this fourth surface unit may be installed in conjunction with a single well having the dual power tube downhole unit, or multiple wells having dual power tube downhole units, or multiple wells having single power tube downhole units, or combinations thereof.

The three single power tube versions of the surface unit can each be used in conjunction with either individual or multiple wells having counterbalance downhole units actuated through a single power tube.

All counterbalance piston assemblies include a multipiston unit slideable within a housing between first and second positions based upon pressure differentials applied to the pistons. The piston assembly and housing define multiple variable volume chambers therebetween including a power chamber, one or more counterbalance chambers, and one or more production chambers. The volume of the power chamber and counterbalance chambers vary inversely as the piston assembly moves between the first and second positions. A power tube structure is provided which has a passage therein in fluid communication with the power chamber. A production tube structure is provided which has a passage in fluid communication with the counterbalance chambers. A first check valve structure is provided for permitting flow of fluid from the formation to the production chamber when the production chamber fluid pressure is less than the formation pressure and preventing reverse flow. A second check valve structure is provided for permitting the flow of fluid from the production chamber to the passage in the production tube structure when the fluid pressure of the production chamber exceeds the pressure in the passage in the production tubing and preventing reverse flow.

The pumping unit positioned remote from the downhole piston unit includes at least one pulser piston having a first face and structure defining a pulser piston cylinder. The pulser piston is mounted for sliding sealed motion along the pulser piston cylinder, the passage in the power tubing being connected to the structure so that the first face of the pulser piston is in fluid communication with the fluid in the power chamber in the piston assembly. Pumping structure is provided for moving the pulser piston in a first direction relative to the pulser piston cylinder to pressurize the fluid in the power chamber through the power tubing structure to a predetermined pressure, the predetermined pressure acting against the downhole piston assembly to move the piston assembly from the first position to the second position. The pumping structure further permits the pulser piston to move in the opposite direction relative the pulser piston cylinder to relieve pressure in the power chamber other than static head and permit the downhole piston assembly to return to the first position under the influence of the static pressure of the production fluid in the counterbalance chambers.

The pumping structure at the top of the well preferably includes a double acting hydraulic cylinder and a hydraulic piston reciprocal therein. Structure is provided for connecting the hydraulic piston and the pulser piston so that movement of the hydraulic piston in a first direction causes the pulser piston to move in the first direction to pressurize the fluid in the power tubing. Pressure sensing control valves are provided for supplying pressurized hydraulic fluid acting on a first face of the hydraulic piston to move the hydraulic piston and pulser piston in the first direction until the predetermined pressure is achieved in the pumping chamber and subsequently entering pressurized hydraulic fluid to act on the opposite side of the hydraulic piston to return the hydraulic piston and pulser piston back to their initial positions. In the dual pulser unit, a separate pulser piston is coupled to each end of the hydraulic piston so that reciprocation of the hydraulic piston in a first direction resets one pulser piston while at the same time moving the other pulser piston through its power stroke. Alternatively, reciprocation of the hydraulic piston in a second opposite direction moves the one piston through its power stroke and simultaneously resets the other.

In the dual power tube piston assemblies, it is not necessary to have any counterbalance pistons since both sides of the power piston constitute power chambers each connected to one of the power tubes. Increased production volume can be achieved by adding additional production pistons. Single production chamber pistons (with their respective backsides vented, such as to the formation) may be coupled to the power piston so that production from at least one production piston occurs on each power stroke of the power piston. However, It is deemed preferable to utilize production pistons which have production chambers on both sides of the piston in order to achieve greater production rate with fewer production pistons.

Figure 3:
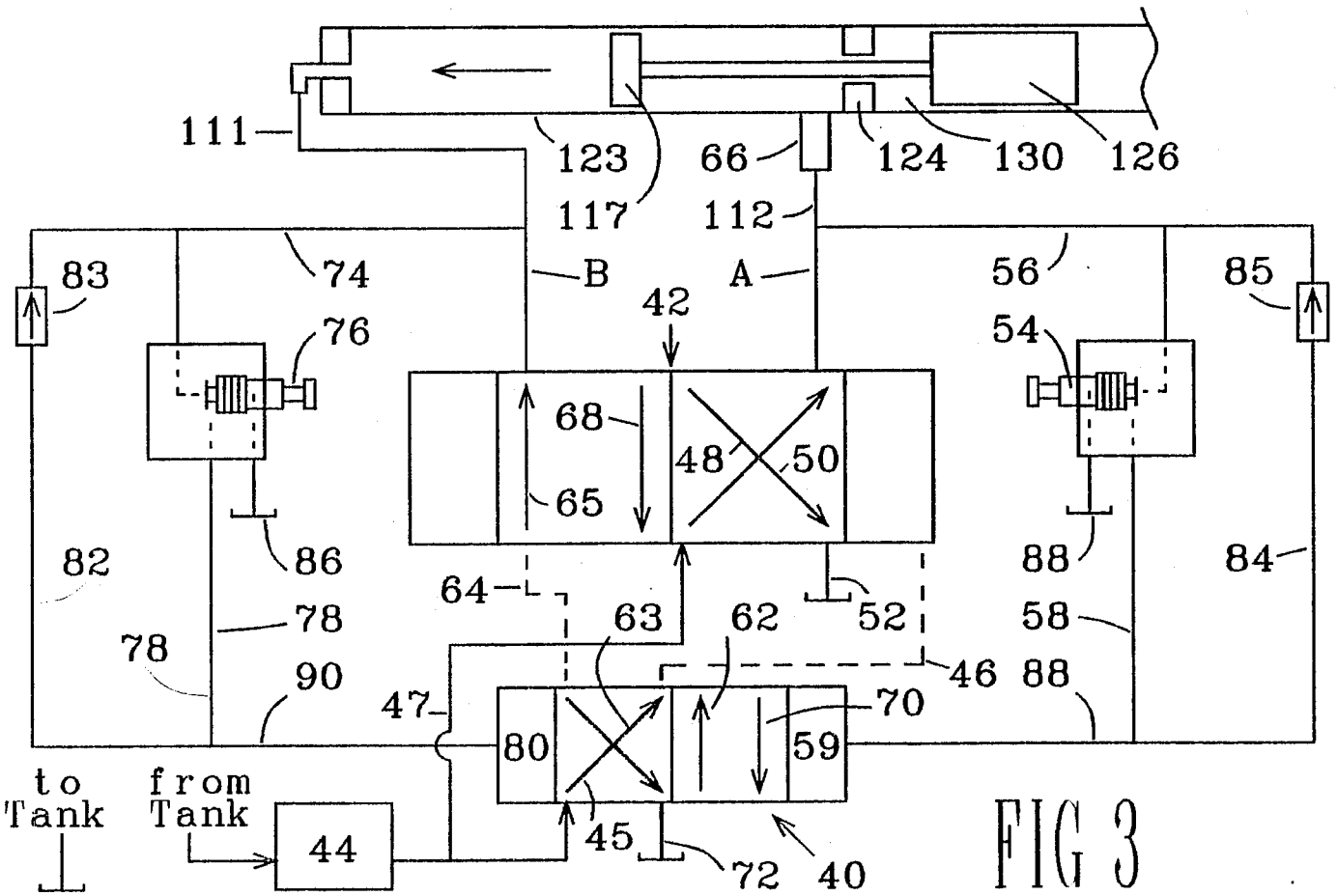
FIG. 3 is a schematic diagram showing the location and interconnections of various pressure sensing valves in the hydraulic actuator unit of FIG. 1.
Figure 4:
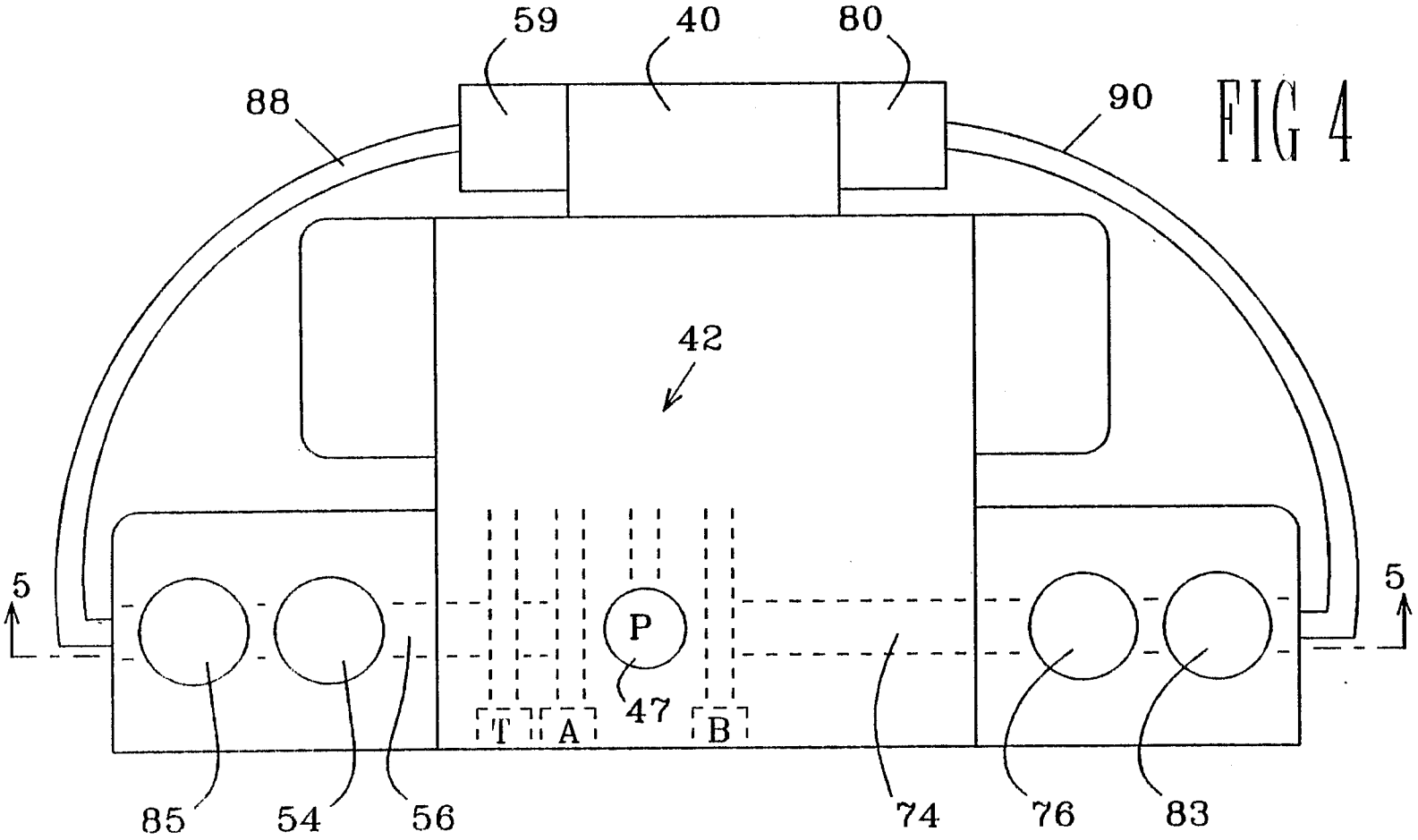
FIG. 4 is a top plan view of an exemplary housing for the pressure sensing valves of FIG. 3.
Figure 5:
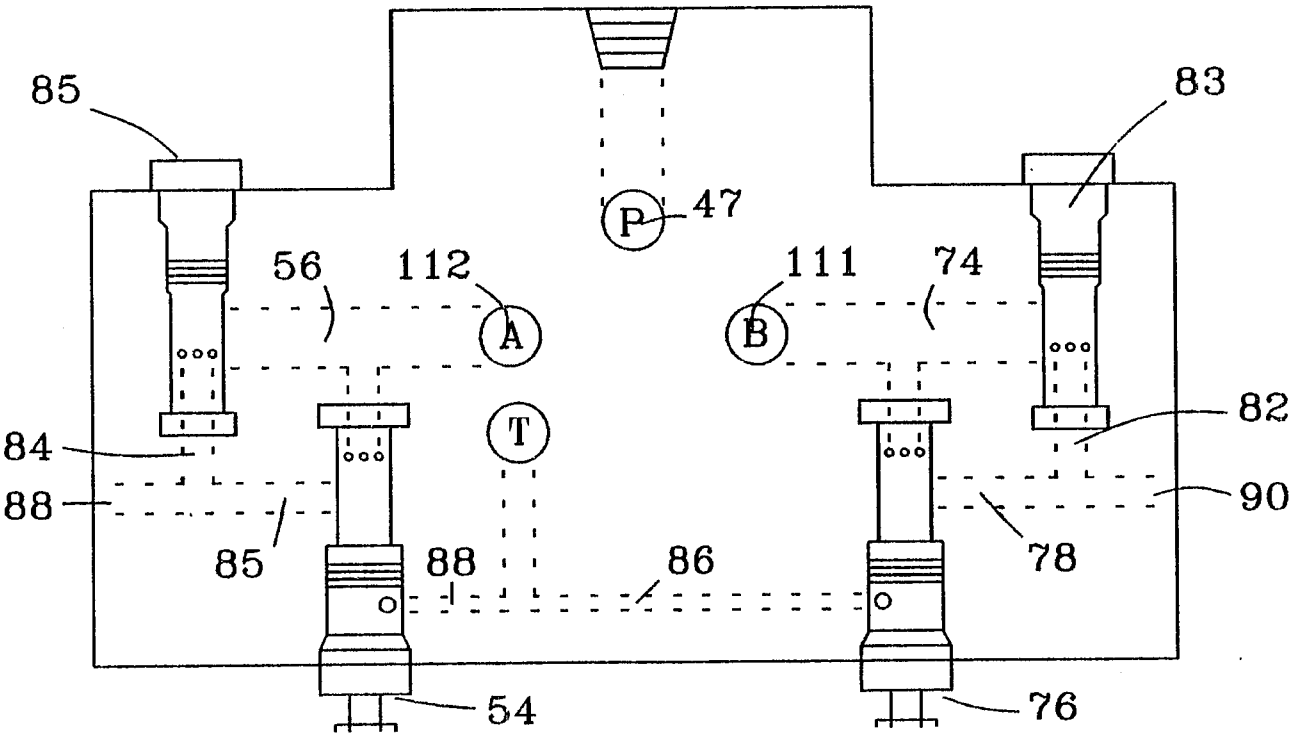
FIG. 5 is a sectional view down along the line 5—5 in FIG. 4.

Generally speaking, the control system for operating the hydraulic piston is shown schematically in FIGS. 3–5. FIG. 3 shows the various valve units aligned for the resetting mode. The control system includes a first pilot operated four-way valve unit 40, and a second pilot operated four-way valve unit 42. In the resetting mode, the hydraulic line A serves as an inlet to the hydraulic cylinder while hydraulic line B serves as an outlet. Thus, the hydraulic fluid comes from the storage tank through a vane pump 44 or other type of hydraulic pump, and passes through the first four-way valve unit 40 along passage 45 through line 46 to one pilot side of the four-way valve 42 in order to position the four-way valve 42 in the resetting mode. In such resetting mode, the normal flow of hydraulic fluid passes along line 47 through a four-way valve passage 48 into the hydraulic line A to fill the hydraulic cylinder and force the hydraulic piston back into its reset position. The hydraulic fluid that necessarily is discharged from the hydraulic cylinder on the opposite side of the piston passes through hydraulic line B and through passage 50 in the four-way valve unit 42 back into the tank at 52. When the hydraulic piston has reached the end of the cylinder to end the reset mode, the pressure in hydraulic line A builds up to a sufficient level to actuate a sequence valve 54 through line 56 so that sufficient fluid pressure goes along line 58 and hose 88 to end cap 59 to actuate the four-way pilot valve 40. Such actuation of the pilot valve 40 causes the change from the reset mode into the power-stroke mode so that hydraulic fluid coming from the vane or hydraulic pump 44 will now pass through passage 62 in the four-way valve unit 40 and proceed through line 64 to the other pilot side of four-way valve unit 42. This serves to actuate the four-way valve unit 42 in order to change it also into the power-stroke mode and thus reverse the flow of hydraulic fluid through the hydraulic fluid lines A B. More specifically, in the power-stroke mode the hydraulic fluid passes from the vane pump 44 through the transmission line 47 but goes through passage 65 into the hydraulic flow line B and thus forces hydraulic fluid into the backside of the hydraulic cylinder to move the hydraulic piston in a forward direction. Hydraulic fluid on the front side of the hydraulic piston therefore returns through port 66 into hydraulic line A and comes back through the four-way valve unit 42 through passage 68 into the tank 52. When the hydraulic piston reaches the end of the hydraulic cylinder in the power-stroke mode, the pressure builds up in hydraulic line B and hydraulic fluid under pressure passing through line 74 activates a sequence valve 76. This causes hydraulic pressure to pass through line 78 and then along hose 90 to end cap 80 in the four-way valve unit 40. The four-way valve unit 40 is then shifted back into the reset mode and the cycle is ready to begin all over again.

It is to be noted that in the power-stroke mode of operation a control circuit flow goes through passage 62 and line 64 to a pilot side of four-way valve unit 42 and back through line 46 and passage 70 into the tank at 72; alternatively in the reset mode a control circuit flow goes through passage 45 and line 46 to a pilot side of four-way valve unit 42 and then back through line 64 and passage 63 into the tank at 72. It will also be noted that pressure release lines 82,84 are connected in parallel around their respective sequence valves 76,54 through one-way check valves 83,85 in order to allow hydraulic fluid to alternately exhaust from the end caps 80,59 when the direction of movement of the piston in the hydraulic cylinder is reversed. When this occurs, the direction of flow in the hose 88 or 90 which connects with the particular end cap discharging the hydraulic fluid is reversed to be away from the end cap and through the appropriate check valve.

Referring to the exemplary embodiment of FIG. 1, the hydraulic control unit 100 is mounted below ground level under a plexiglass cover 101 inside a protective casing 102. A production line 103 coming from the wellhead goes into a hydraulic tank 105 to go through a heat exchanger (see FIG. 15) inside the hydraulic tank and then out through a continuation 104 of the production line to a collection area (not shown). An electric motor 106 drives a hydraulic pump 107 in order to draw hydraulic fluid from the tank through line 108 through a high pressure filter 109 to a pressure sensing valve controlling unit 110 which includes the necessary four-way valves and sequence valves whose operation has already been described in detail previously. Thus, hydraulic fluid pumped from the hydraulic tank to the valve controller 110 passes through one of hydraulic lines 111, 112, while a return flow of hydraulic fluid passes back through the other of hydraulic lines 111,112 to the valve controller 110 and ultimately through a low-pressure exhaust filter 113 back into the hydraulic tank.

It will be seen from the drawing that in this embodiment, the top of the wellhead is clear of any visual or physical obstruction, since the only things protruding from above the wellhead is a hydraulic cylinder end-plate 114 through which passes inlet/outlet lines 115, 116 which connect the opposite ends of a hydraulic chamber having a hydraulic piston 117 therein, and a priming pipe 118 connected through a one-way check valve 119 to the production line 103. The only other item above the wellhead is the top of production pipe 120 which connects through junction 121 to the production line 103 in one direction and a primer hose 122 in another direction.

The piston displacement unit located down inside the wellhead includes an upper cylinder 123 for housing the hydraulic piston 117, and this upper chamber is separated by a coupling 124 from a lower pulser cylinder 125 for holding an elongated pulser piston 126 having seals 127 and 128 at either end. The lower portion 129 of the pulser cylinder below the pulser piston constitutes a chamber for holding power fluid, while the upper chamber 130 above the pulser piston constitutes an isolation chamber which is vented through aperture 131 for any blowby past the pulser piston. It will therefore be appreciated that the power fluid is separated from the hydraulic fluid so that they each constitute a separate closed system performing separate but related functions. The bottom of the pulser cylinder 125 terminates in a coupling 132 for joining the pulser cylinder 125 with a short seating nipple 133. The bottom end of the primer pipe 118 communicates with the power fluid through the coupling 132.

In order to seal the production fluid which comes up production pipe 120 from the power fluid, two separate passages are provided from a coupling 134 downhole to a piston assembly (not shown) adjacent the well formation. In the illustrated form, an interior power tube 135 of, for example, $\frac{3}{4}$ inch diameter extends from the seating nipple 133 and through the coupling 134 to the downhole piston assembly, and this power tube is located inside of an enlarged diameter discharge pipe 136, such as 2 inches in diameter, to create an annular space 137 between the outside of the power tube and the inside wall of the discharge pipe. Seating cups 138 are provided at the top of the power tube to seal the annular space off from the passage carrying the power fluid.

Figure 2:
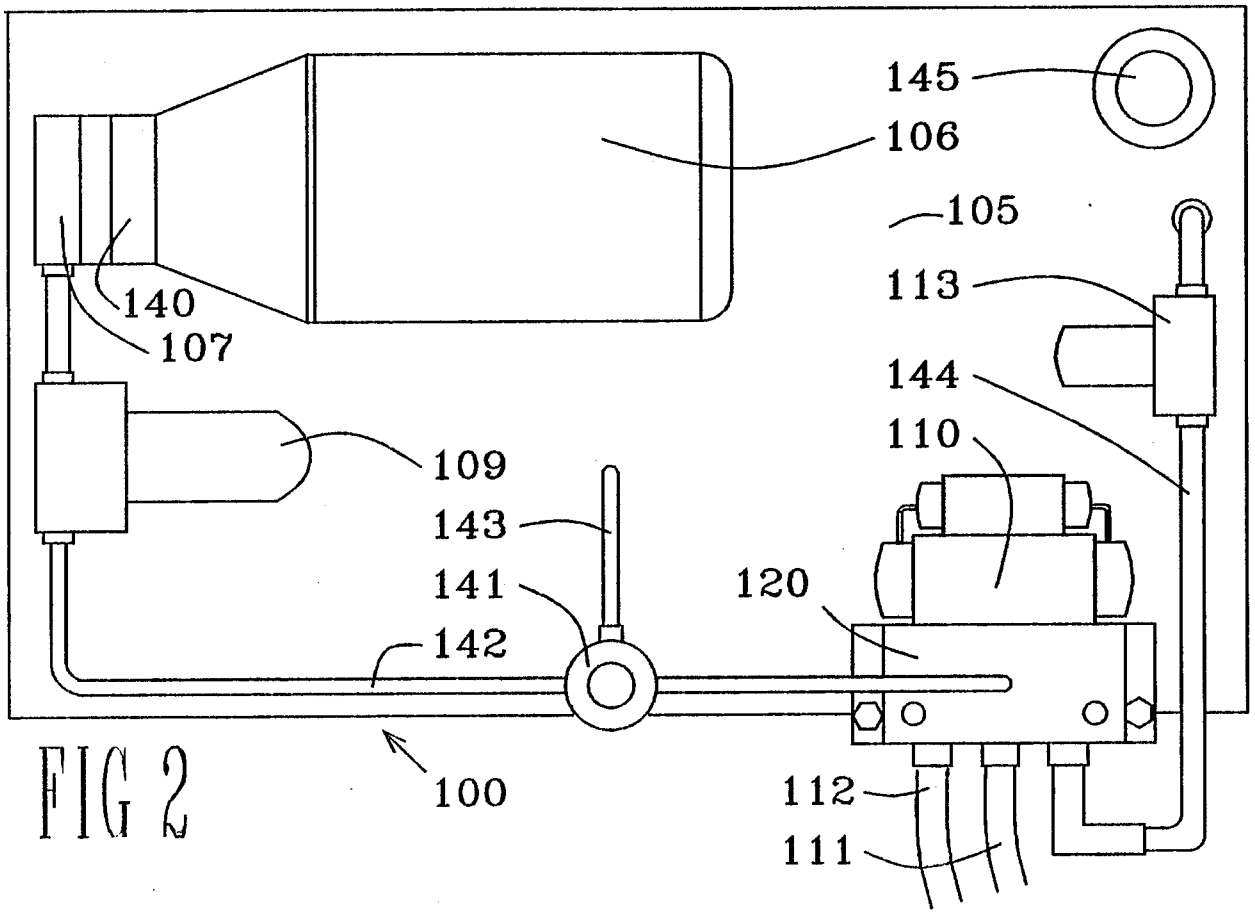
FIG. 2 is a top plan view of the hydraulic actuator shown in FIG. 1.

Referring to FIG. 2, further details of the hydraulic control unit 100 are shown. In that regard, an insert 140 is provided for the vane pump in order to be able to vary the volume capacity of the pump for different wells. Of course, other state-of-the-art pumps such as a piston displacement pump can be used in order to achieve the same variation in pumping volume which is desirable in order for the system to be adaptable for different well specifications. The pressure relief valve 141 is included in the hydraulic line 142 connecting the high-pressure hydraulic filter 109 with the valve controller unit 110, and a return line 143 connects the pressure relief valve 141 back to the reservoir tank 105. The particular components of the valve controller unit 110 have been previously shown and described in connection with FIGS. 3,4 & 5. A tank return line 144 goes from the valve controller unit through the return filter 113 and back to the reservoir tank. A filler cap 145 is provided for sealing the tank during use and for allowing the tank to be refilled with hydraulic fluid as needed.

Figure 15B:
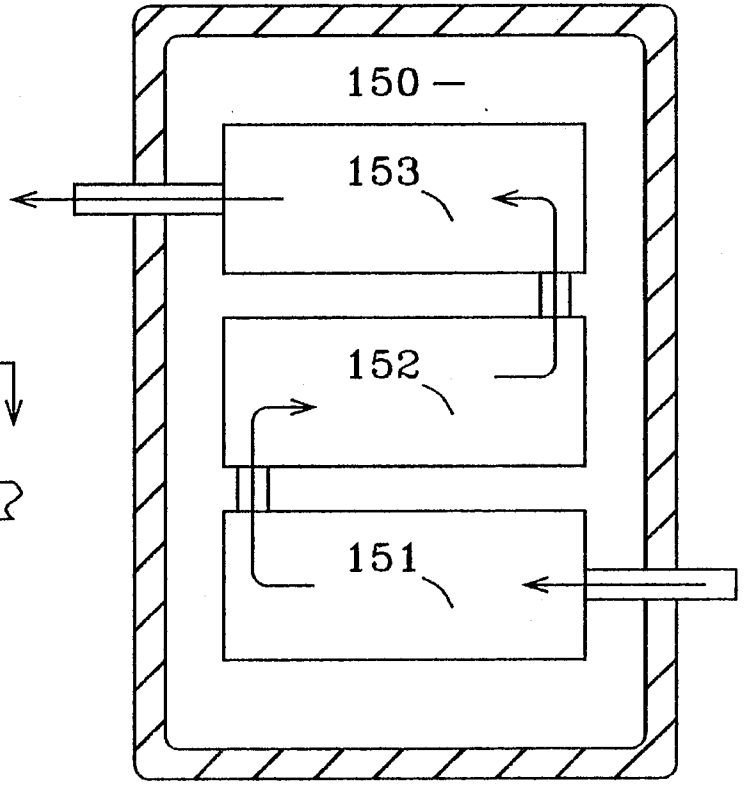
FIG. 15B is a top view taken along the line 15B—15B of the hydraulic reservoir of FIG. 15A.
Figure 15A:
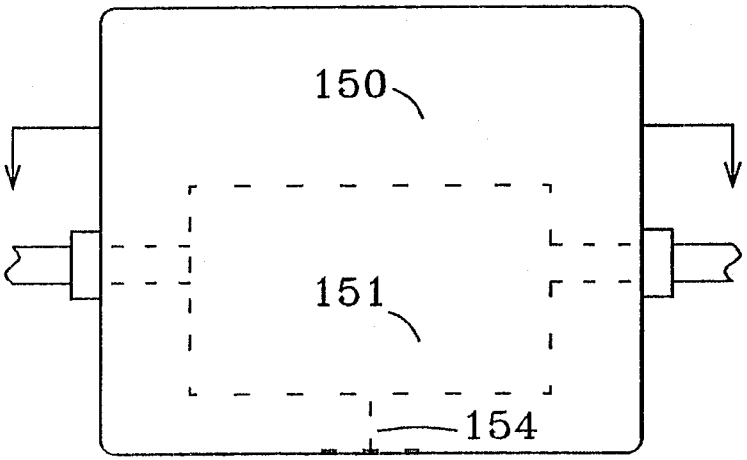
FIG. 15A is a side view of a heat exchanger mounted in the reservoir of a hydraulic actuator unit.

Referring to the illustrated embodiment of a heat exchanger unit 150, it was found desirable to incorporate a plurality of cylinders 151, 152, 153 inside of the hydraulic tank in order to provide maximum surface area for exposure to the hot hydraulic fluid in the tank, as well as to dissipate any excessive pressure in the production line and alleviate any excessive stress on any point of the heat exchanger. Thus, each heat exchange cylinder 151, 152, 153 is of a shortened length relative to the inside dimensions of the hydraulic tank, and similarly a shorter height relative to the corresponding inside diameter of the hydraulic tanks, and are each supported by a suitable bracket 154 in order to be raised off the bottom of the tank. Thus, the slow passage of the production fluid through the hydraulic tank serves to transfer much of the undesirable heat in the hydraulic fluid away from the tank without any serious risk of the production fluid becoming intermixed with the hydraulic fluid. This cooling effect facilitates satisfactory operation of the hydraulic control unit through a unique technique based on conservation of energy. Although there are various ways of designing a suitable heat exchanger unit, the drawing of FIG. 15 shows a presently preferred embodiment which was developed through experimentation.

Additional benefits result from heating the production fluid. For example, to the extent the production fluid constitutes a mixture of petroleum and water, the raised temperature of the production fluid after it leaves the heat exchanger helps keep certain parts of the mixture in suspension and facilitates the separation which occurs at a collection point. Also, during cold weather the raised temperature of the production fluid prevents freezing in its distribution pipes, thereby allowing them to run along the ground rather than being buried below the frost line or otherwise insulated.

Figure 6:
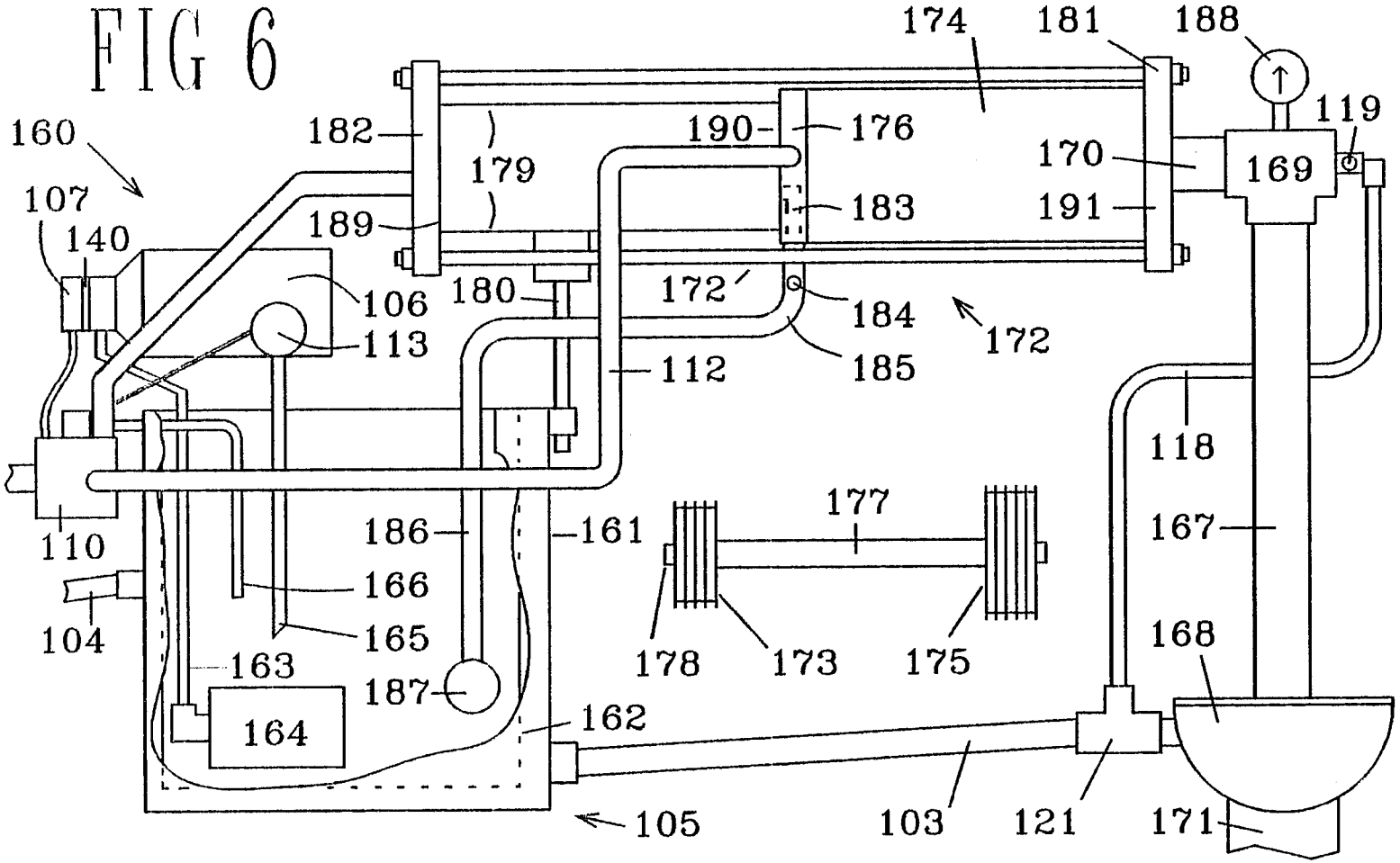
FIG. 6 is a second embodiment of a hydraulic control unit having a hydraulic actuator unit coupled to a pulser displacement unit mounted horizontally adjacent a wellhead.

Referring to the exemplary embodiment of FIG. 6, the hydraulic control unit 160 is mounted above the ground and shows a pulser displacement unit which is mounted horizontally adjacent the wellhead in order to achieve the benefits of the invention. More particularly, the hydraulic tank includes an outer wall 161 and an inner wall 162. In order to allow room for mounting the pulser displacement unit on top of the tank and extending toward the wellhead, the electric motor and hydraulic vane pump are mounted at the other end of the tank, and the valve controller is mounted on the side of the tank. The other parts and components of the hydraulic control unit are like those already described for the embodiment of FIGS. 1 and 2, with additional features which were not previously described. An inlet line 163 from the tank to the pump includes a suction filter 164. Also shown is a tank return line 165 from the return filter and also a tank return line 166 from the valve controller.

It will be seen from the drawing that in this embodiment it is necessary to extend a power tube 167 above a wellhead cap 168 up to a T-Junction 169 which connects in one direction through pipe 170 to the pulser displacement cylinder and in the other direction through a one-way check valve, which one-way check valve operates as in the previously described embodiment of FIGS. 1–2. However, in this embodiment, a well casing 171 provides the outer boundary for an annular production tube whose inner boundary is defined by the power tube 167. This eliminates the need for a separate production pipe down in the wellhead.

The horizontally mounted pulser displacement unit includes a hydraulic cylinder 172 for carrying a hydraulic piston 173 and a pulser cylinder 174 for carrying a pulser piston 175. The two cylinders are separated by a central wall 176 which seals off the two chambers from each other, but provides a central slot for journaling a connecting shaft 177 which extends between the two pistons. Each piston is attached to the shaft by suitable end nuts 178 in order to provide the usual trade-off between actuating force and cylinder volume. Interior wall liners 179 can be provided for making the hydraulic cylinder diameter smaller for receiving a smaller diameter hydraulic piston, while at the same time leaving the pulser piston diameter larger for receiving a larger-diameter pulser piston. The pulser displacement unit is supported from the tank at one end by a suitable support bracket 180, and at the other end through end plate 181 to the power tube connecting pipe 170. Another end cap 182 closes off the other end of the pulser displacement unit, and it provides an entry for one of the hydraulic lines. The other hydraulic line is connected to the opposite end of the hydraulic cylinder through the middle wall 176. Additionally, a port 183 in the middle wall connects through a one-way check valve 184 to a primer line 185 which draws hydraulic fluid from a primer pipe 186 having an intake filter 187 inside the hydraulic tank. This provides the supplemental flow of hydraulic fluid into one end of the hydraulic chamber during the resetting stroke when a downhole counterbalance piston provides additional force up through the power tube which resets the hydraulic piston faster than the hydraulic pump can normally supply fluid to the hydraulic cylinder. A pressure gauge 188 is mounted at the top of the power tube 167 to monitor the pressure of the power fluid as the hydraulic piston 173 and the pulser piston 175 reciprocate through a power stroke and a resetting stroke. A stop 189 at one end of the hydraulic cylinder 172 acts to terminate the resetting stroke. In contrast, the stops 190, 191 at the other end of cylinders 172, 174, respectively, are for backup purposes only, since on the power stroke the length of travel of the hydraulic piston/pulser piston unit is variable and only terminates when suitable compressibility is achieved in the the power fluid and in the downhole production chamber and after the downhole production piston clears all production fluid out of the production chamber into the annulus 171 (which constitutes the production pipe). In this regard, the inlet to the production chamber from the formation and the outlet from the production chamber into the production pipe are preferably at the same end of the production chamber to facilitate the complete clearing of the production chamber at the end of each power stroke.

Figure 7:
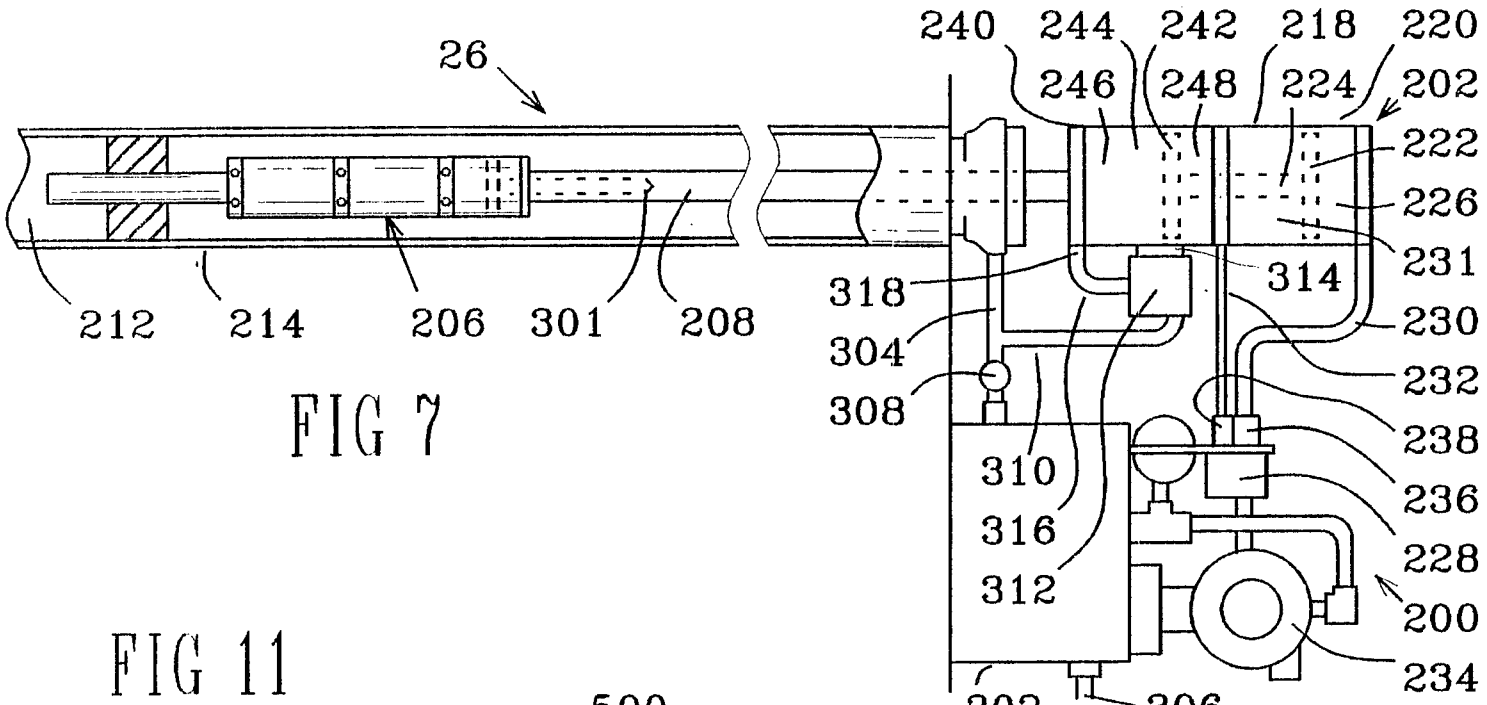
FIG. 7 is a third embodiment of a hydraulic control unit with its hydraulic actuator unit coupled to a pulser displacement unit vertically mounted directly above a wellhead and showing a multi-piston assembly forming the downhole unit.
Figure 8A:
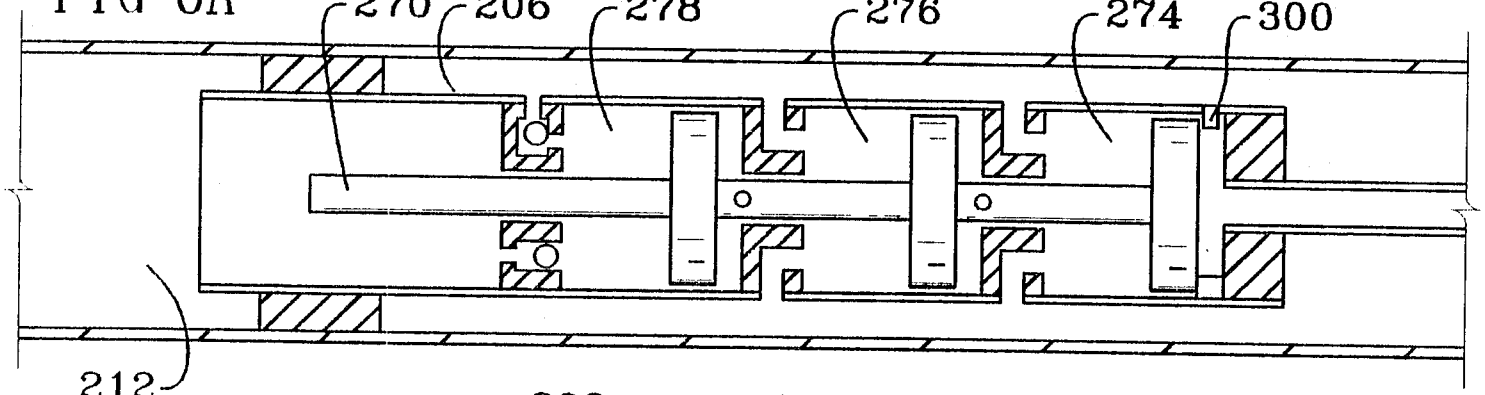
FIGS. 8A and 8B show the multi-piston assembly of FIG. 7 at its upper and lower limits.
Figure 8B:
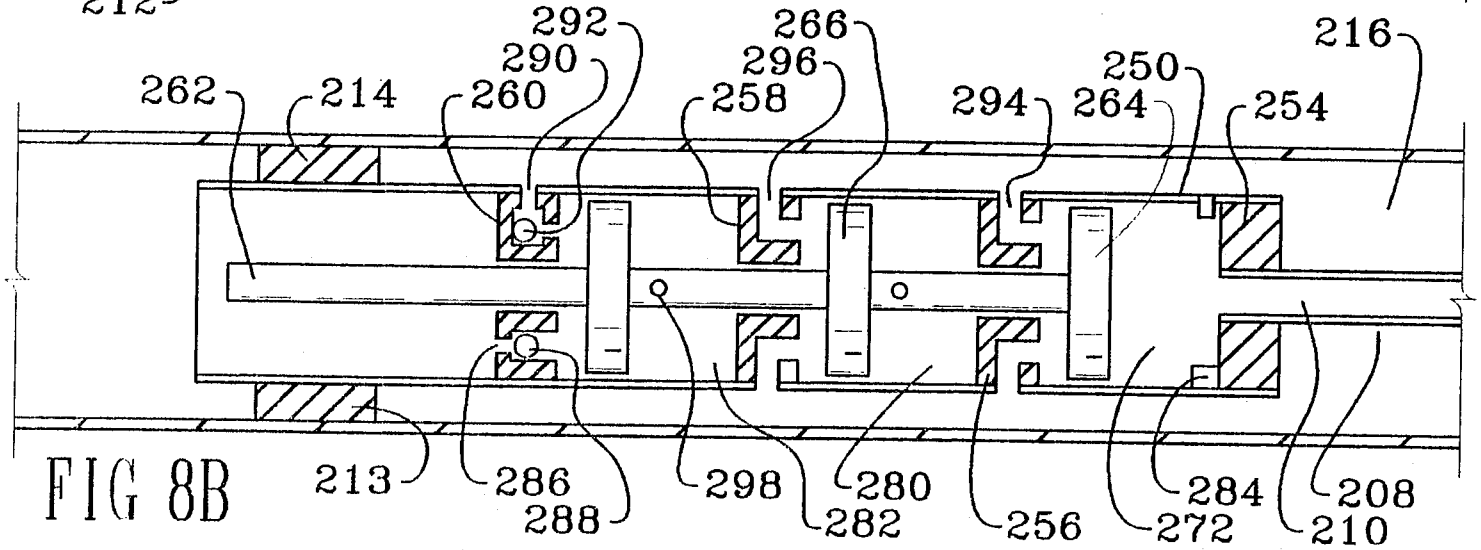

With reference now to the embodiment of FIGS. 7 and 8, the pumping apparatus consists of three main units: a hydraulic power unit 200 on the surface, a pulser displacement unit 202 at the top of the well, and a downhole piston assembly 206 which fits inside of a well casing 214 and extends into a subterranean formation 212. The pulser displacement unit 202 and downhole piston assembly 206 are connected by a power tube 208 having a passage 210 therein. A packer 213 seals between a housing of the downhole unit 206 and the well casing 214 to define an annular passage 216 isolated from the formation fluid 212.

The pulser displacement includes a double-acting hydraulic cylinder assembly 218 including a cylinder 220, a piston 222 for slideable sealing contact with the inner surface of the cylinder 220 and a piston rod 224 connected to the piston 222.

The hydraulic cylinder assembly 218 defines an upper chamber 226 above piston 222. The upper chamber 226 is connected to a four-way valve 228 through upper hose 230. The assembly 218 further defines a lower chamber 231 which is connected to the four-way valve 228 by a lower hose 232. The four-way valve 228 alternately supplies high pressure hydraulic fluid from a pump 234 to the chambers 226 and 231 to reciprocate the piston 222 between its uppermost limit as seen in FIG. 7 downwardly to a position sufficient to produce a pretermined pressure within the power tubing 208 as will be described hereinafter.

The operation of the four-way valve 228 is first controlled by a hydraulic sequence valve 236 sensing the pressure within the upper hose 230 as the piston 222 moves toward its lowermost limit. When a predetermined production pressure is reached, the sequence valve 236 causes switching of the four-way valve 228 so that it now supplies hydraulic fluid below piston 222. The operation of the four-way valve 228 is now controlled by a second sequence valve 238 which senses the pressure in the lower hose 232 as the piston 222 moves towards its uppermost limit. When the predetermined resetting pressure is reached, the sequence valve 238 reverses the four-way valve 228 so that it now supplies hydraulic fluid above piston 222 to restart the cycle all over again. In practice, there are stops formed at the top end of cylinder 218 which engage the piston 222 when it reaches the end of the resetting stroke, and the additional hydraulic fluid supplied through lower hose 232 has no place to go and therefore creates the pressure spike that actuates sequence valve 238. In contrast, the piston 222 reaches the end of the power stroke without ever abutting against any stops at the bottom end of cylinder 218, since it is a stop means in the downhole piston assembly which determines the end of the power stroke.

In the downhole piston assembly, it is preferably the power piston which abuts a stop to end the power stroke, while it is the counterbalance piston which abuts a stop to end the resetting stroke. In other words, the downhole piston directly receiving the activating force is the one to hit the stop, thus minimizing stress along the connecting rod between the various downhole pistons.

The pulser piston assembly 240 is mounted immediately below the hydraulic cylinder assembly 218. The piston rod 224 extends from piston 222 to a rigid connection with a pulser piston 242. Pulser piston 242, in turn, moves in slideable sealing contact with a cylinder wall defined on a pulser piston chamber 244. The upper end of the power tube 208 opens into the lower chamber 246 below the pulser piston 242. It can be readily understood that as the piston 222 moves downwardly from its uppermost limit, the pulser piston 242 moves downwardly to pressurize the fluid within the power tube 208. The upper chamber 248 is preferably vented, such as to the atmosphere. Otherwise, any residual hydraulic fluid and/or power fluid which enters chamber 248 due to blowby leakage past hydraulic lock the piston, damage the seals, or allow undesirable interchanging or intermixing of the power fluid with the hydraulic fluid.

The downhole unit 206 is at least partly submerged within the formation fluid 212 at the bottom of the well 26. The downhole unit 206 is shown supported within the well by the power tube 208, although other supporting structure can be used.

The downhole unit 206 includes a housing 250 having a generally cylindrical shape which extends into the formation with its interior 252 divided into various sections by walls 254, 256, 258 and 260. A piston assembly 262 is provided within the housing 250 and includes an upper piston 264, middle piston 266 and lower piston 268 all interconnected by a central shaft 270. The piston assembly 262 and housing 250 define a power chamber 272, a first counterbalance chamber 274 and a second counterbalance chamber 276, a production chamber 278 and two chambers 280 and 282.

The piston assembly 262 is moveable from its uppermost position with upper piston 264 contacting upper stops 284 to its lowermost position with one or more of the respective pistons contacting the end walls. If possible, the top piston is the only one to actually abut against the end walls in order to minimize undesirable stress throughout the piston assembly.

The shaft 270 passes through walls 256, 258 and 260 and is sealed therewith to isolate the various chambers. As shown, the lower surface of wall 260 is exposed to the fluid in the formation. A passage 286 extends through the wall 260 and contains a chack ball 288 which cooperates with the passage 286 to define a check valve for permitting fluid to flow from the formation into the production chamber 278 when the fluid pressure in the formation exceeds the pressure in the production chamber. The wall 260 also is provided with a passage 290 which connects the production chamber to the annular passage 216 extending to the surface. The passage 290 also contains a check ball 292 and defines a check valve permitting fluid to move from the production chamber to the annular passage when the pressure in the production chamber exceeds the pressure in the annular passage. In the typical application of the present pumping assembly, the fluid in the annular passage 216 proximate passage 290 will have a significant static head and the fluid in the production chamber 278 must be pressurized above the static pressure to open the check valve and permit flow from the production chamber to the annular passage.

The counterbalance chambers 274 and 276 are in fluid communication with the annular passage 216 through passages 294 and 296. The chambers 280 and 282 are in communication with the fluid in the formation through the hollow center of the shaft 270 by way of ports 298. The upper end of the passage through the shaft 270 is closed by a high pressure relief valve 300 which normally isolates the power chamber 272 from the passage through shaft 270 unless the pressure in the power chamber 272 achieves a very high pressure to open the relief valve 300. This relief valve 300 will be closed in all normal operation of pumping apparatus, but does permit direct communication between the power tube 208 and the formation should some treatment of the formation be necessary. Also, a silt preventer 301 is employed at the bottom of power tube 208 to prevent any silt or foreign matter in tube 208 from getting on piston 264. Preventer 301 has a cone-shaped top to deflect debris into the annulus between the bottom of preventer 301 and tube 208 with ports near its upper portion to allow fluid communication between the downhole unit 206 and tube 208.

In a typical operation of the invention, pump 234 draws hydraulic fluid from a reservoir 302 and pressurizes the hydraulic fluid for entry into the upper chamber 226. The pressurized hydraulic fluid drives the piston 222 and pulser piston 242 downwardly to pressurize the fluid column within the power tube 208 and the fluid within the power chamber 272. The pressurization causes the piston assembly 262 to move downwardly away from stops 284 against the static pressure of the production fluid in the annular passage 216 acting against the lower surfaces of the upper piston 264 and middle piston 266. As the piston assembly 262 moves downwardly, the portion of the formation fluid within the production chamber 278 is pressurized so that is flows from the production chamber into the annular passage 216 passed check ball 292 in passage 290. Pressurized hydraulic fluid will continue to be supplied to the upper chamber 226 to move pistons 222 and 242 downwardly until sufficient pressure has been built up in the power tube 208 representing movement of the piston assembly 262 to its lowermost extent. This causes an abrupt surge in pressure in the upper chamber 226 and upper hose 230 until the predetermined threshhold pressure which activates the sequence valve 236 is reached, thereby reversing the four-way valve 228 and redirecting the pressurized hydraulic fluid to the bottom of the piston 222 to move the piston 222 and pulser piston 242 to their uppermost position. As the pressure is relieved within the power tube 208, the only pressure remaining on the upper surface of upper piston 264 is the static head of the fluid in the power tube 208. However, as the static head of the production fluid in the annular passage 216 acts on approximately twice the surface area, represented by the bottom surfaces of the upper piston 224 and middle piston 266, the static pressure of the production fluid drives the piston assembly 262 upwardly until the upper piston 264 contacts the upper stops 284, ready to begin the cycle anew. As the piston assembly 262 rises, a relative vacuum is created in the production chamber 278 which draws a portion of the formation fluid through passage 286 past check ball 288 into the production chamber for the subsequent power/pumping stroke. The production fluid passes upwardly through the annular passage 216 out a production line 304 and into a heat exchanger in the reservoir 302 where it is employed to cool the hydraulic fluid used to operate the hydraulic cylinder assembly 218. From reservoir 302, the production fluid then flows through line 306 to an approprate holding tank.

A pressure relief valve 308 is provided within the production outlet 304 to allow the pressurization of the production fluid. The valve 308 thus allows additional counterbalance static force to be applied to lift piston assembly 262 and control the return speed of piston assembly 262.

A line 310 extends from line 304 to a small reservoir box 312. A direct connection extends from the box 312 to check valve 318 and into the chamber 244 near its bottom. The reservoir box 312 can be any device for separating gas from the production fluid so that only liquid passes into line 316. This setup is used to keep the power tube completely filled or primed with supplemental liquid.

In normal operation, the power tube at the start of the downstroke is completely filled with power fluid. Losses of power fluid may occur through faulty or loose seals, small leaks and the like, and this leakage creates a void or partial vacuum in the power tube. This partial vacuum typically occurs when the pulser piston approaches its uppermost limit of travel. Thus, by the end of the upper limit of travel of the pulser piston, any partial vacuum or void created during each cycle has been eliminated by refilling the power tube with small amounts of production fluid through the one way check valve 318. Of course, it would be possible to provide a bleeder for the power tube in instances where it is desirable to be able to draw gas directly from the power tube. Also, other sources of priming liquid for the power tube can be used, such as hydraulic fluid from the hydraulic reservoir, specialized power fluid, or the like.

The fluid in power tube 208 can initially be drawn from any available water tank or alternatively some other source of supply. However, once the power fluid is put into the power tube, it acts as a closed system separate and apart from the production fluid, and separate and apart from the hydraulic fluid. One benefit of using a closed system of power fluid is to prevent contamination of the hydraulic fluid and to prevent contamination of the power fluid. Also, this helps to prevent gas locking of the unit due to excessive gas content in the power fluid or in the production chambers. In that regard, in the present device the displacement volume of hydraulic piston 222 will exceed the displacement volume of the piston assembly 262 to assure uniform reciprocation of piston assembly 262 despite the compressibility of fluid in power tube 208. For example water will compress approximately $\frac{1}{3}$ of one percent per 1000 psi pressure and the pumping apparatus will compensate for the factor by making the stroke of piston 222 sufficiently long to assure uniform reciprocation of piston assembly 262 and constant displacement of the production fluid in production chamber 278 on each stroke, since pressure sensing device 236 will not reverse the downward motion of piston 222 until the predetermined pressure is achieved. Use of a closed system pumping fluid in tube 208 also extends the maintenance life of pulser piston 242 and top piston 264. Marine oil (designed to maintain separation from water) can be used to keep pulser piston 242 exposed to oil if water is used in tube 208. This allows the pulser piston 242 to be exposed to oil instead of water, and further increases the maintenance life of the seals.

The advantages of the closed system of power fluid are enhanced by the use of hydraulic cylinder assembly 218 which further assures that the movement of the piston assembly 262 of the downhole unit will be independent of compressibility variations in the fluid in the power tube and variations in the production chamber. The stroke of the hydraulic cylinder assembly 218 is variable with the stroke being determined by pressurizing the fluid within the power tube 208 to assure a uniform movement of the piston assembly 262 downhole. This feature allows for use of various mixtures of fluids in power tube 208 with a wide range of compressibilities and for pumping production fluids with a wide range of compressibility and gaseous content without any need for adjusting pump action because the stroke of the piston 222 remains solely dependent on the pressure of the hydraulic fluid.

In normal operation, the return of the downhole pistons may reset the surface pulser and its attached hydraulic piston assembly faster than the flow of hydraulic fluid entering into chamber 231. Therefore, a void forms in chamber 231 and time is lost waiting for the hydraulic fluid to fill chamber 231, when the hydraulic piston is already in its uppermost position. To keep this chamber full of hydraulic fluid throughout the upstroke, a primer line is provided extending from the hydraulic fluid reservoir through a one way check valve opening into chamber 231. The one-way check allows fluid to be pulled into chamber 231 on the upstroke as the vacuum is formed. At the hydraulic piston's uppermost limit of travel, the chamber 231 is filled and there is no waiting time (with the resultant lost energy) for the hydraulic fluid to fill the chamber.

Figures 9, 10:
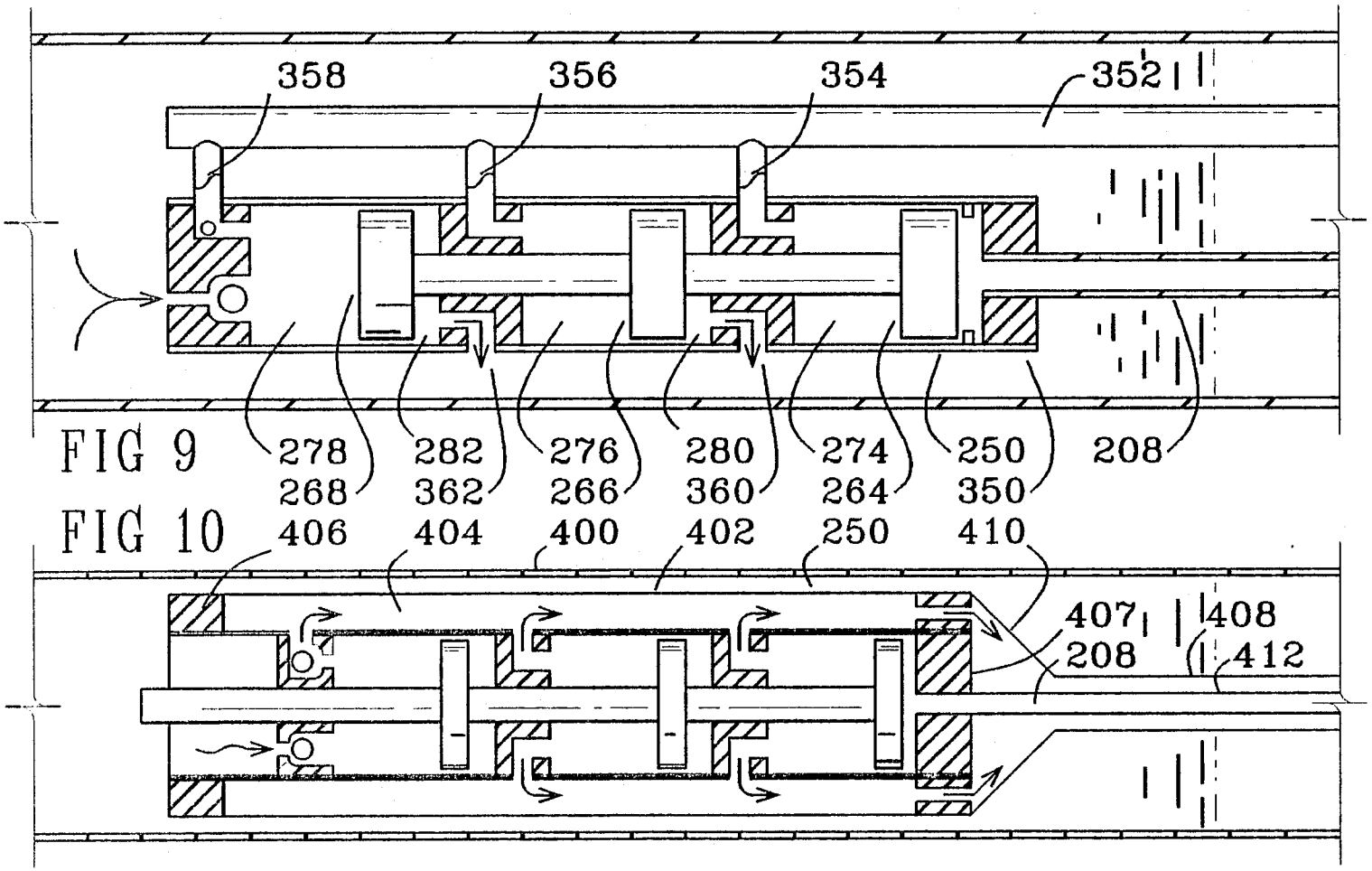
FIG. 9 illustrates a modified multi-piston assembly incorporating a separate production tube.
FIG. 10 illustrates another modification of the multi-piston assembly incorporating a central production tube.

FIG. 9 illustrates a modification of the pumping apparatus which employs a modified downhole unit 350. Many elements of unit 350 are identical to elements of unit 206 and are identified by identical reference numberals. As can be seen, the packer 216 has been eliminated and a separate production tube 352 is provided for moving the production fluid to the surface. Conduits 354, 356 remain open at all times to connect the two counterbalance chambers 274, 276 with the production conduit 358 connects production chamber 278 with the production tube 352 through a one-way check valve tube 352. Passages 360 and 362 connect the reservoir chambers 280 and 282 to the reservoir through the housing 250, so that the shaft 364 connecting the pistons 264, 266 and 268 can be solid. In all respects, the operation of the downhole unit 350 is identical to that of downhole unit 206.

With reference not to FIG. 10, another modification of the pumping apparatus is illustrated which includes a downhole unit 400. A number of elements of downhole unit 400 are identical to those found in downhole unit 206 and are identified by the identical reference numeral. However, downhole unit 400 is provided with a cylindrical casing 402 which surrounds the housing 250 to define an annular passage 404 in communication with the counterbalance chambers and production chamber. The passage 404 is isolated from the formation at its lower end by a plug 406 and from chamber 272 at its upper end by plug 407. At its upper end, the casing 402 is connected to a production tube 408 which extends to the surface by a transition section 410. As can be seen, the production tube 408 and power tube 208 have coincident central axes and the production fluid can move to the surface in the annular chamber 412 between the inside of tube 408 and the outside of power tube 208.

Figure 11:
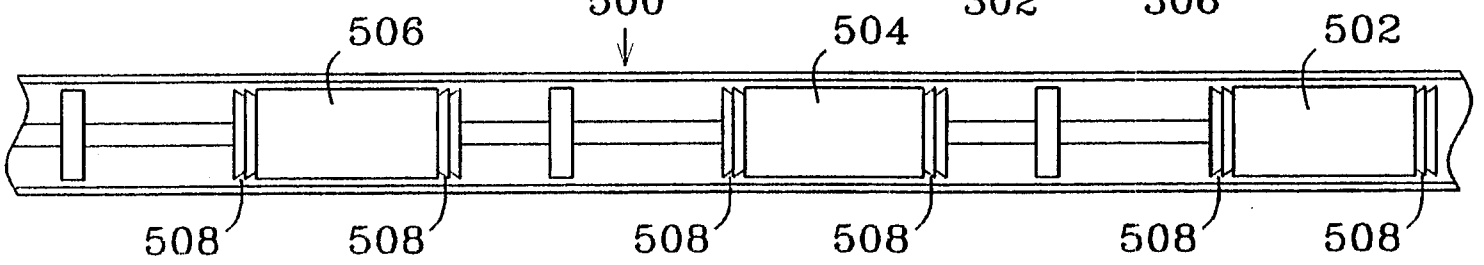
FIG. 11 illustrates a further modification of the multi-piston assembly incorporating elongated piston heads.

With reference to FIG. 11, a further modification of pumping apparatus is shown which illustrates a downhole unit 500 which functions in a manner substantially identical to that of downhole unit 206. However, downhole unit 500 employs relative elongate close tolerance pistons, including upper piston 502, middle piston 504 and lower piston 506. Each of the pistons has a set of soft seals 508 at either end for sealing against the inside of the housing 250. Preferably, the length of each of the pistons is approximately one foot for each thousand feet of depth that the downhole unit is positioned within the well in order to minimize risk of significant blowby past the piston seals. by close tolerance pistons are means pistons which have a diameter no more than 0.005 inches less in diameter than the inside diameter of the housing wall. These close tolerances provide for more effective sealing between chambers. The soft seals 508 also provide for wiping and improved static and dynamic sealing and can consist of leather, leather-rubber composites, fabric-rubber composites or other suitable materials.

In order to minimize blowby past the pulser piston, it was found desirable in many instances to use an elongate pulser piston head following the same ratio guideline of one foot of pulser piston length for each thousand feet of well depth.

The method and apparatus of the present invention allows the pump installer to determine in advance the operating range for a specific pump installation based on the depth of the well, the diameter of the well casing, the potential rate of flow, and the desirable range of flow. If all those factors necessitate the design of a downhole piston assembly that moves through a linear displacement of an extended length, it is nevertheless possible to still have a relatively short linear displacement of the pulser piston located at the top of the well. Accordingly, one of the advantages of the present invention is that is is possible to achieve a linear downhole stroke of the power piston which is several times the distance of the linear surface stroke of the pulser piston. This is achieved relatively easily by making the cylinder for the pulser piston a larger diameter as compared to the diameter of the downhole power chamber. Thus, a high ratio of comparative linear displacements can be obtained. Of course, the volume displacement of both the pulser piston cylinder and the downhole power chamber will still be the same. Since the volume of the cylinders is computed by the formula $V=\pi r^2 h$, the volume increases by the square of the radius. Thus, it does not require a much larger diameter of the pulser cylinder in order to create a high ratio between the linear travel of the downhole unit pistons and the linear travel of the surface pulser piston.

Of course, in some instances a one-to-one linear displacement ratio between the pulser piston and downhole power piston is desirable and necessary, as with the embodiment of FIGS. 1–2 installed in a relatively shallow 500 foot well.

The other important factor to determine is the diameter of the so-called counterbalance chamber. By increasing the diameter of the counterbalance piston and its associated housing, the amount of resetting force can be increased and therefore the time interval needed for the resetting stroke can be shortened. In a relatively shallow well, where the static head of the production fluid does not create very much force, it is desirable to design a large diameter counterbalance piston in order to increase the force on the resetting piston relative to the offsetting forces of friction, weight of the downhole piston assembly, and the like. In contrast, in a deep well, the force provided by the long column of production fluid extending from the surface down to the piston assembly is much more than is required. Therefore the counterbalance piston must be reduced in diameter in order to prevent malfunction or other problems due to excessive force during the resetting stroke.

However, in most instances, the downhole counterbalance piston can be "overbuilt" (i.e., made much larger than is necessary) so that the additional force provided during the resetting stroke serves to convert the power tube into a reverse power transmission means. Under this condition, the power fluid in the power tube transmits force from the downhole piston assembly back to the surface in order to help reset the pulser piston and its connected hydraulic piston. When this occurs, the hydraulic piston moves faster than the hydraulic pump can provide hydraulic fluid, and the priming line between the hydraulic reservoir and the hydraulic cylinder provides the additional hydraulic fluid to fill the partial vacuum which is created in the hydraulic cylinder. Under these conditions the hydraulic pump and motor expend less energy to reset the hydraulic piston than would otherwise occur, and the extra force provided by the overbuilt counterbalance piston is used efficiently. Moreover, since the resetting stroke takes less time, the power stroke can now take more time so that a lower volume vane pump can be used. This keeps the time for a complete cycle (power stroke plus resetting stroke) the same while achieving a significant overall energy savings.

Of course, once the size of the downhole counterbalance piston is fixed and the length of stroke of the downhole piston assembly definitely determined, the complete time interval for the resetting stroke cannot thereafter be decreased. Thus, each complete installation has a maximum frequency for a pumping of a well. If the speed of the hydraulic pump is increased, this will not only increase the rate at which the hydraulic piston moves on the power stroke, but will also unduly increase the resetting of the pulser piston. If the hydraulic vane pump thus moves the pulser piston too fast on the resetting stroke, the partial vacuum created in the power tube will draw in unneccessary priming fluid from the production tube, thereby overfilling the power tube and preventing a full power stroke by the downhole piston assembly on the next cycle.

It will be appreciated that the counterbalance portion of the downhole power piston is close to equilibrium (except for its own weight and for the smaller surface area of the counterbalance side of the power piston as compared to the power side) since the static head of the production fluid against the lower face of the power piston is offset by an almost identical head of power fluid against the upper face of the power piston.

However, it will be understood that the pumping rate or pumping volume of the hydraulic pump can readily be lowered below the maximum level in order to achieve a desirable BPD production rate without having to turn off the pump for part of the day. Thus, a full range of cycle frequencies up to a certain maximum are possible from a single counterbalance installation.

One advantage to the dual power tube downhole unit is that the need for staying within a maximum cycle frequency is eliminated, since there is no counterbalance resetting force to take into consideration.

Figure 18:
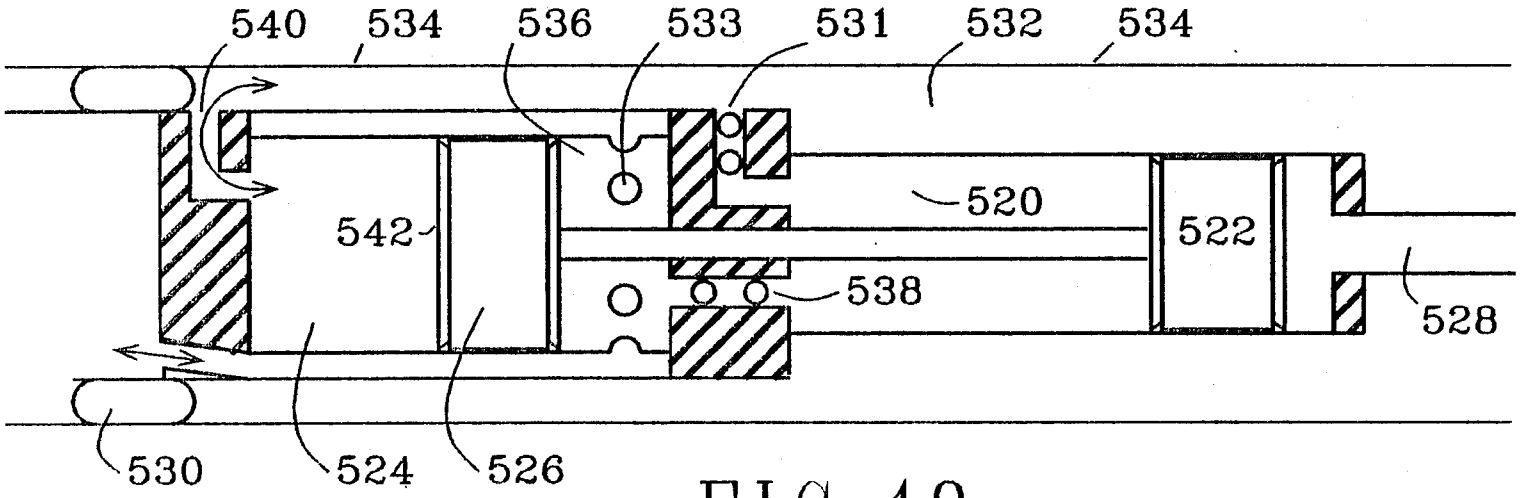
FIG. 18 illustrates still another modification of the multi-piston assembly incorporating a single counterbalance piston and a single power/production piston.

With reference to FIG. 18, a further modification of pumping apparatus is shown which incorporates a two piston downhole counterbalance assembly. It will be appreciated that this two piston variation of the downhole piston assembly accomplishes the same purpose as the previously described three piston unit, and can be incorporated with any of the previously described hydraulic controller and pulser displacement tophole units. A production chamber 520 is located below a top piston 522 while a counterbalance chamber 524 is located below a bottom resetting piston 526. The bottom resetting piston 526 is designed to have a larger cross-sectional area than the corresponding area of the top piston 522 which faces head of power fluid in the power tube 528. Packer 530 seals off the annulus 532 which serves as a production tube between a well casing 534 and the power tube 528. On the downstroke, the fluid in the production chamber 520 is forced through outlet checks 531 into the annulus 532. At the same time, formation fluid is going through vents 533 into a transfer chamber 536 above the top face of the resetting piston 526. During the upstroke or resetting stroke, the force due to head pressure on the lower face of the bottom piston is greater than the combined forces provided by residual resistance of the system and the effective pressure of the power fluid against the top/upper face of the top piston. Thus, during the upstroke, fluid from the vented chamber 536 is drawn into the production chamber 520 through inlet checks 538. Excess fluid due to the larger volume of the transfer chamber as compared to the lesser volume of the production chamber is returned to the formation. During the upstroke, the production fluid enters through passage 540 into counterbalance chamber 524 as the static head of production fluid in the annulus 532 exerts the resetting force against the bottom face 542 of the piston 526.

Typical pressure curves based on pressure variations in the hydraulic fluid system are shown in FIG. 16 for counterbalance downhole piston assemblies installed with the unique hydraulic control unit and the pulser displacement cylinder means of the present invention. A large range of flow rates and pressure parameters and time interval changes can be made without having to make any structural changes in the pulser displacement unit or the hydraulic control unit. In other words, the cycle frequency can be varied as well as the pressure specifications and related time intervals for the power stroke and the resetting stroke without having to reinstall a different downhole piston assembly and/or a different pulser displacement unit and/or a different set of control valves in the hydraulic actuator unit. When it is desirable to substantially change the production rate of a well, it was found that the use of a variable displacement hydraulic piston pump was the only significant change of components needed. Alternatively, a variable rate electric motor or installing different volume control inserts could be used with a vane pump in order to modify its rate of operation.

Figures 16A, 16B:
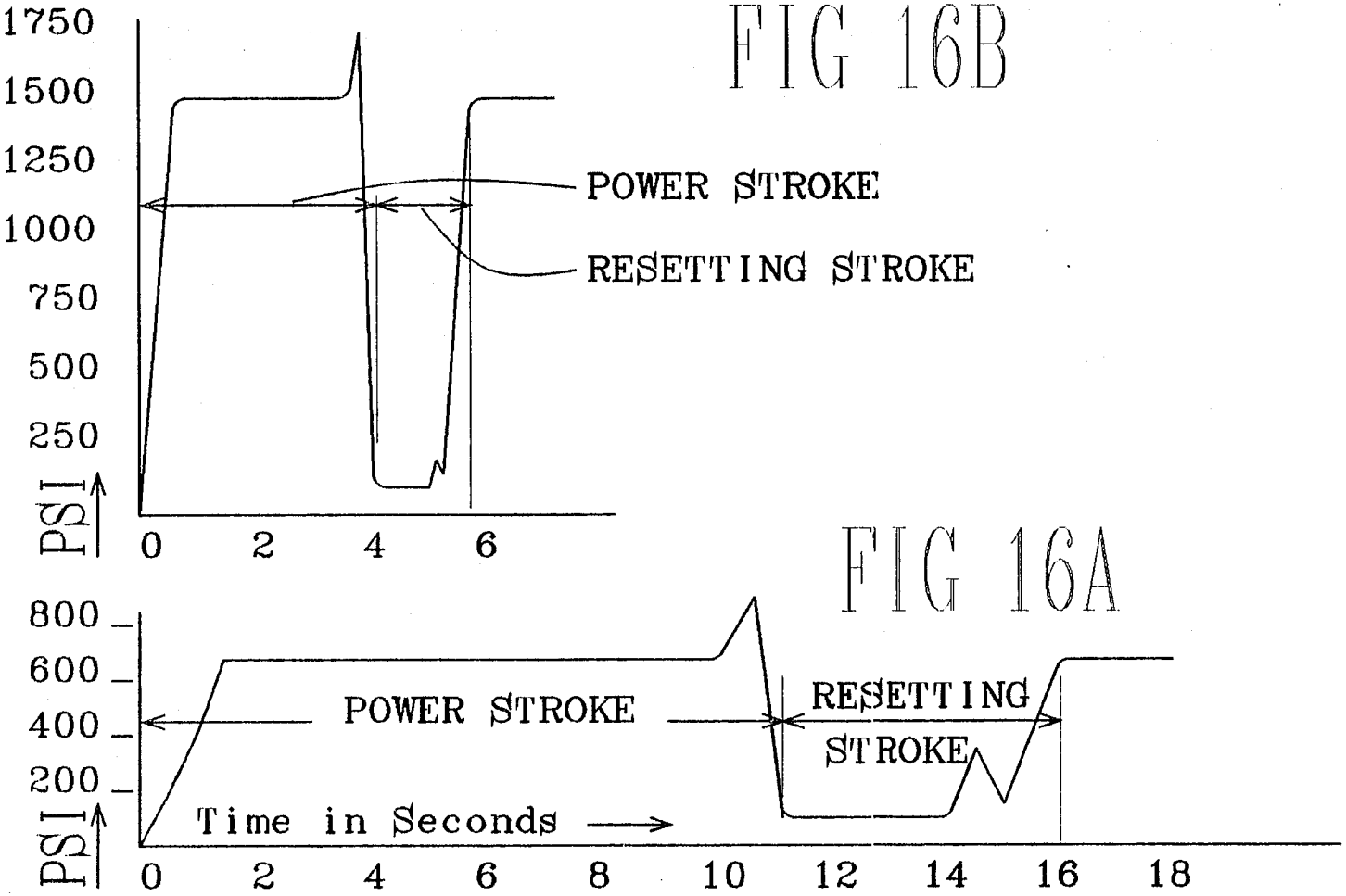
FIGS. 16A and 16B are timing diagrams for multipiston counterbalance downhole units installed in typical 500 foot and 2000 foot wells, respectively, showing exemplary pressure changes in the hydraulic control lines through the power and resetting strokes.

More specifically, FIG. 16A shows a projected exemplary timing cycle, for a relatively shallow 500 foot well in which the compression pressure of the cycle is about one second, the effective portion of the power stroke about nine seconds at approximately 650 psi, a pressure spike for about $\frac{1}{3}$ of a second up to 850 psi, an immediate drop to the system pressure of 100 psi which remains during about 4 $\frac{1}{2}$seconds of the resetting stroke, which terminates in a second pressure spike up to 250 psi which then goes through a compression pressure of the new power stroke.

FIG. 16B shows a similar timing cycle for a 2000 foot well where the various parameters and specifications are different from those shown in FIG. 16A. It will therefore be appreciated that many desirable variations of this type of pressure cycle can be accomplished with the method and apparatus of the present invention for a variety of shallow and/or deep wells as well as high volume and/or low volume wells under diverse environmental conditions.

Figure 12:
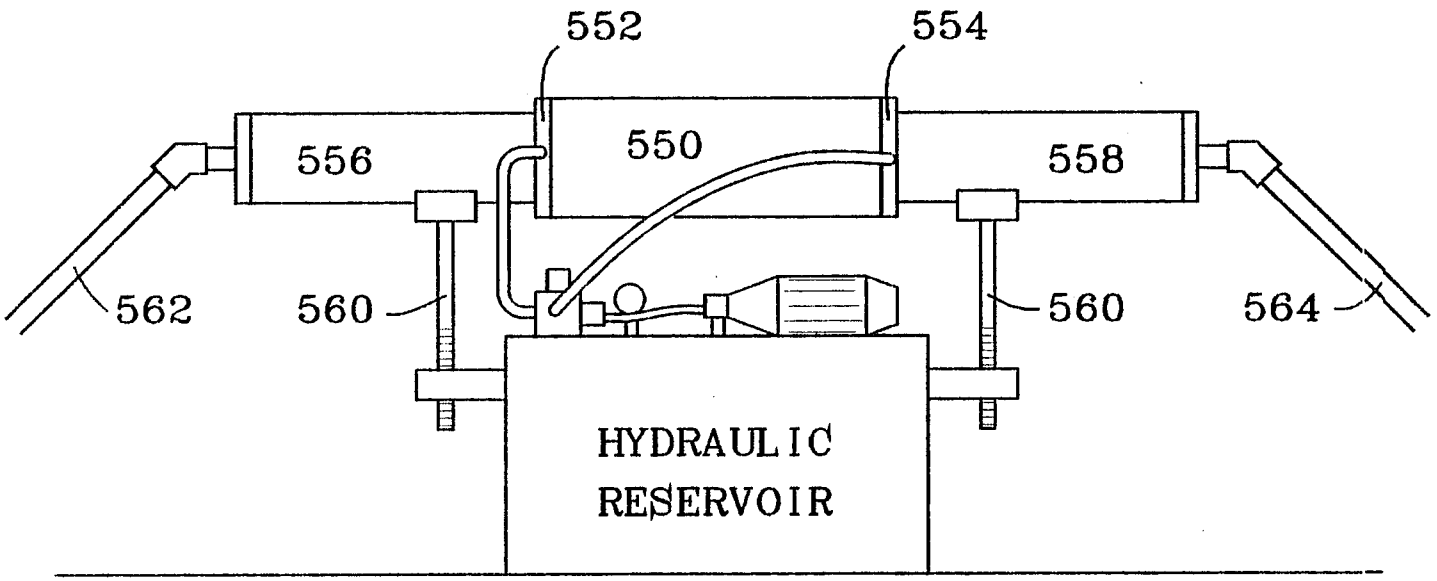
FIG. 12 is a fourth embodiment of a hydraulic control unit showing a horizontally mounted pulser displacement unit having two separate pulser pistons for single or multiple well installations.
Figure 21:
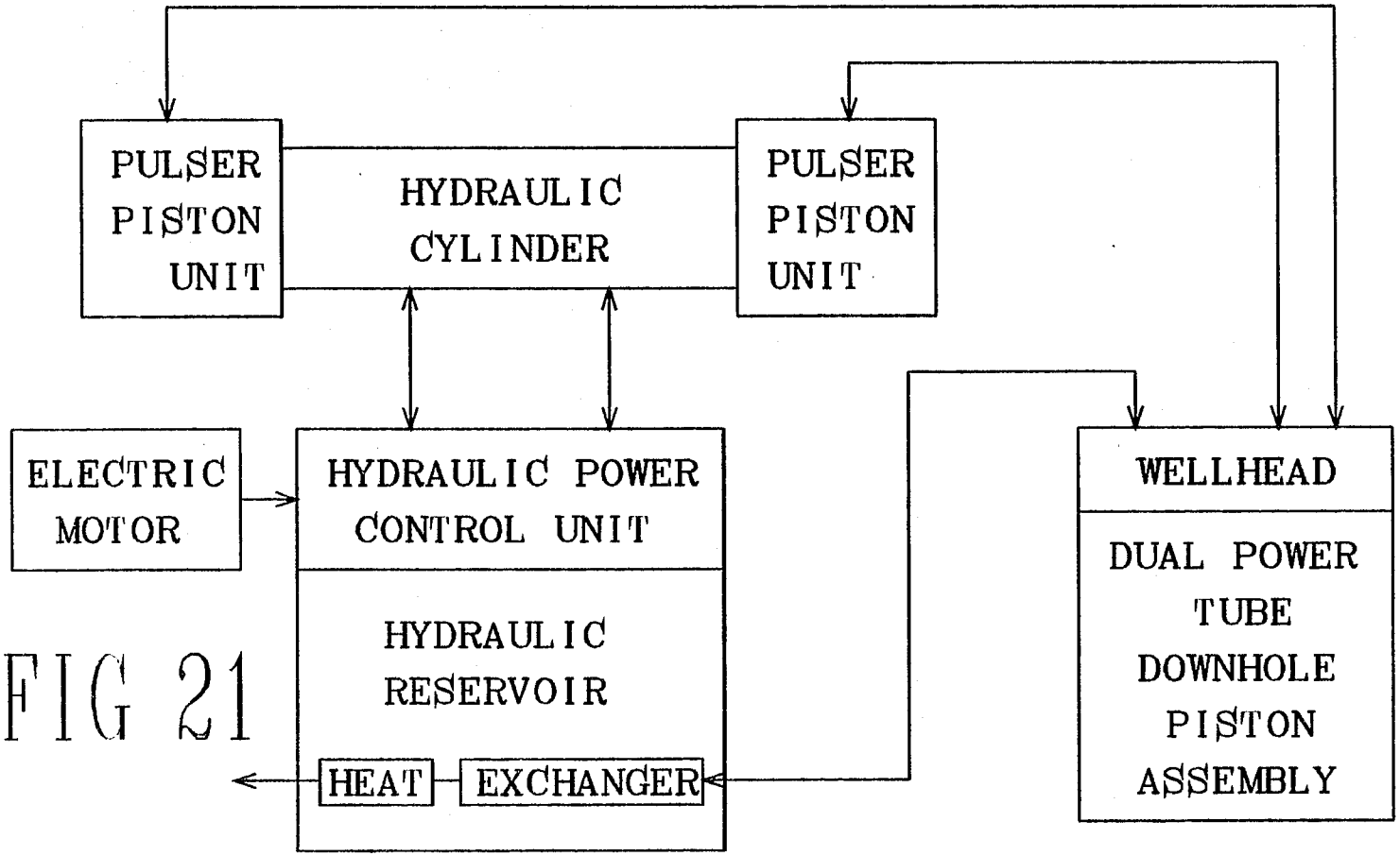
FIG. 21 is a schematic block diagram showing a dual pulser unit used with a single well installation.
Figure 22:
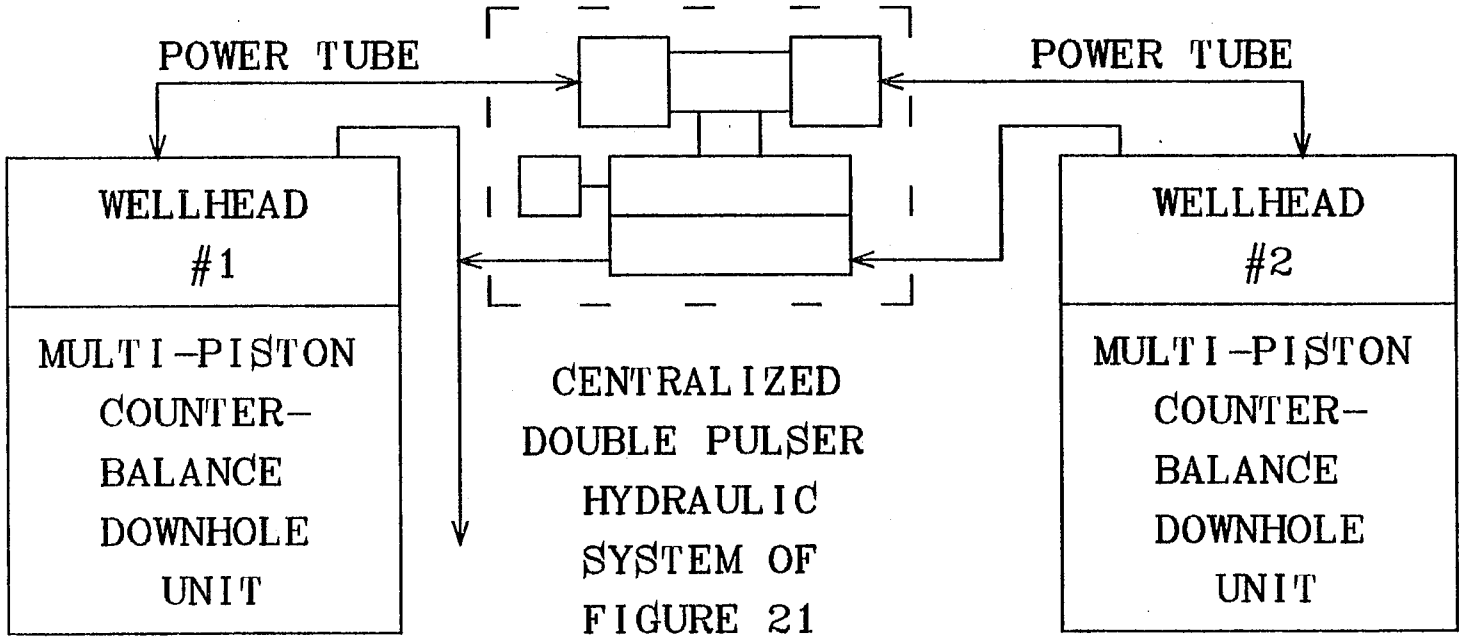
FIG. 22 is a schematic block diagram showing a dual pulser unit used with two separate well installations.

With reference to FIG. 12, a further modification of the pumping apparatus is shown which incorporates a dual pulser surface unit. It will be be appreciated that this unit is adaptable for use in various single (FIG. 21) and multiple (FIGS. 19, 22) well installations using downhole counterbalance units (single power tube) as well as downhole dual power tube units (no counterbalance chambers).

A central hydraulic cylinder 550 is closed at its ends by plates 552, 554 which provide a boundary between the hydraulic cylinder and two pulser cylinders 556, 558, respectively. Brackets 560 support the three cylinders to be spaced above the hydraulic reservoir which is incorporated with the usual hydraulic components as previously described. The diameter of the hydraulic cylinder is shown to be enlarged since this embodiment is often used with higher volume hydraulic pumps in order to achieve the increased force necessary for high frequency and/or high volume operation. The two power tubes 562, 564 can both go to the same well to activate a dual power tube down-hole unit, or alternatively to two separate wells each having their own counterbalance downhole units, or to multiple wells as discussed in more detail below.

It will thus be understood that since the only significant structural difference between this embodiment and the previously described surface or tophole units is the feature of a pulser piston on both sides of the hydraulic piston. The same hydraulic power system and the same multipiston single power tube downhole unit can be used in combination with this unique pulser displacement unit.

When in operation, as the hydraulic and pulser pistons move to the right, the downhole unit in the well(s) on the right is going through its downstroke. At the same time, the downhole unit(s) in the well(s) on the left is undergoing its upstroke phase. Just the opposite occurs during the next half of the cycle.

This dual pulser unit because of the built-in advantages of its design has efficiency which is greater than the single pulser units, primarily because the pulser pistons are at all times moving production fluid from the production chamber and there is no delay time for the downhole unit to reset. In that regard, the energy usage per well per volume pumped is estimated to be almost down to half of the energy consumed by an equivalent pumpjack installation (See FIGS. 13–14).

Figure 17:
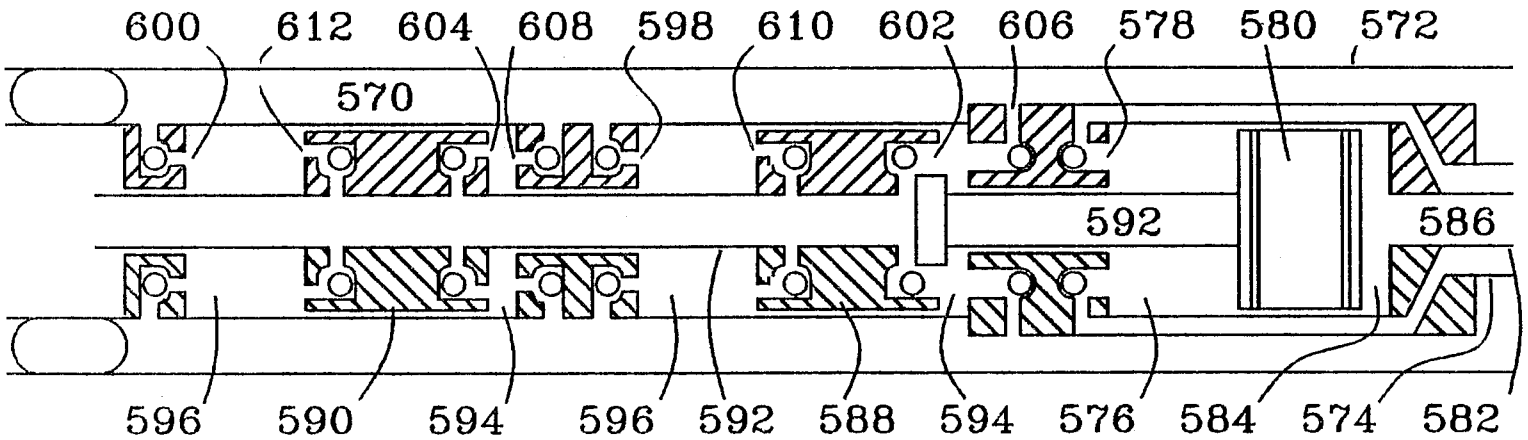
FIG. 17 illustrates an additional modification of the multipiston assembly incorporating two power tubes.

With reference to FIG. 17, a further modification of pumping apparatus is shown which incorporates in the illustrated embodiment two or more downhole pistons. It will be appreciated that this unit operates in somewhat the same manner as the previously described multipiston downhole assemblies, except for the fact that the counterbalance chamber with its resetting piston has been eliminated. In other words, the downhole power piston has a power stroke in both of its directions and there is no limit on the time it takes for any of the strokes in any direction because each power stroke automatically resets one or more of the production pistons simultaneously during such power stroke.

In this illustrated embodiment, an annulus 570 between a well casing 572 and an outer power tube 574 constitutes a production tube for carrying production fluid up to the wellhead. The outer production tube 574 communicates to a first power chamber 576 through aperture 578 on one side of a power piston 580 while an inner production tube 582 communicates to a second power chamber 584 on the other side of the power piston 580 through aperture 586. One or more production pistons 588, 590 are attached to the power piston by a connecting rod 592 which has a central passage connecting the well formation with upper 594 and lower 596 production chambers.

On the downstroke, production fluid storage volumes in production chambers 596 are forced out into the annulus 570 through check valves 598, 600. At the same time new formation fluid is flowing into production chambers 594 through check valves 602, 604. On the upstroke, the fluid volume in production chambers 594 are forced into the annulus through check valves 606, 608. At the same time new formation fluid is flowing into production chambers 596 through check valves 610, 612.

Of course it will be understood that one or more production pistons can be employed to increase the production volume, and that it would be possible to use a single production chamber piston if deemed appropriate or desirable so that half the production pistons produce fluid in the annulus on one power stroke and the rest produce fluid in the annulus on the other.

Figure 19:
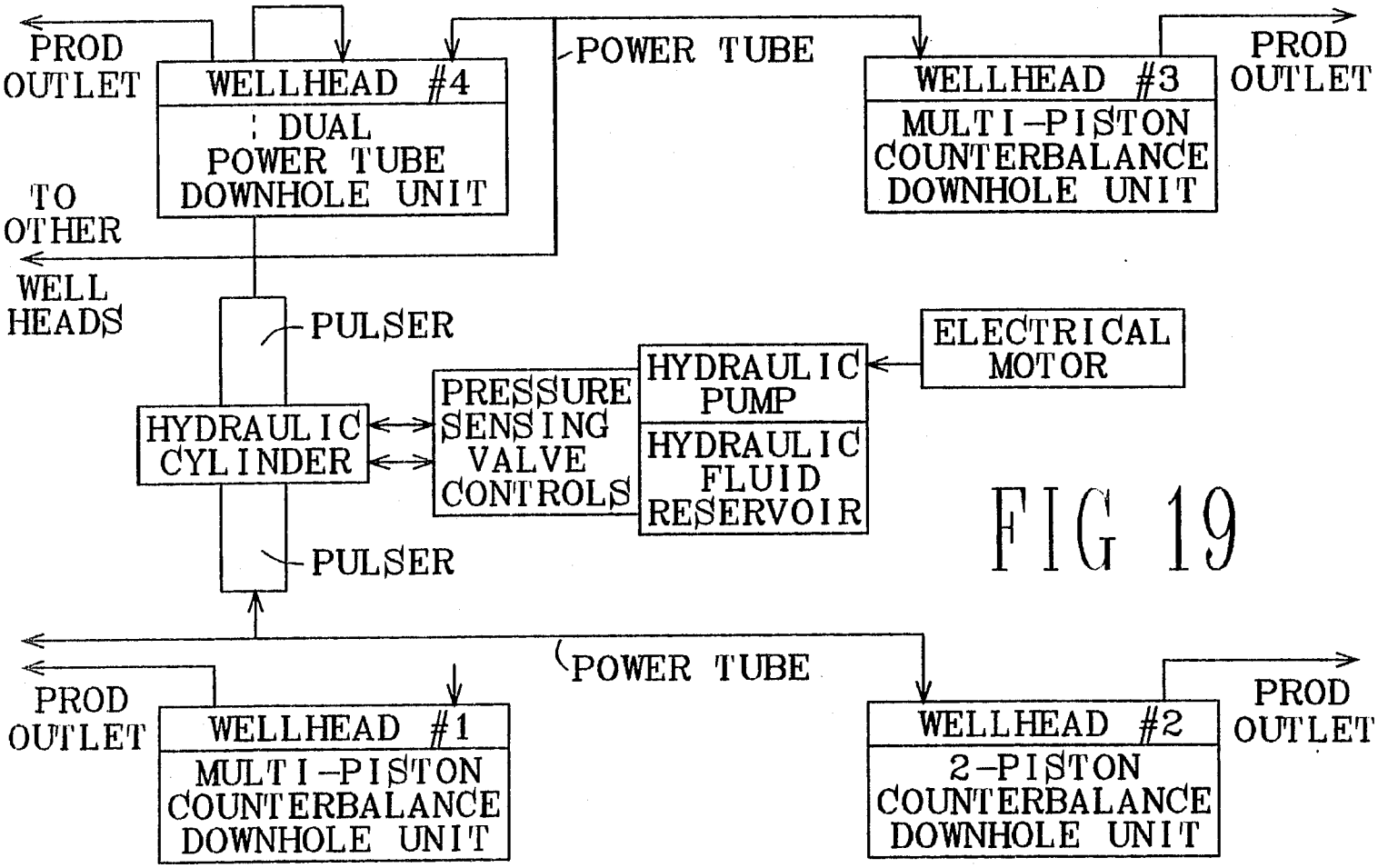
Fig. 19 is a schematic block diagram showing multiple well installations with a centralized dual pulser unit.

As best shown in the block diagram of FIG. 19, the double acting hydraulic cylinder incorporates a pulser piston cylinder at each end and is adaptable for use in pumping one or more wells located adjacent to or displaced remotely from the hydraulic actuator unit. Moreover, such multiple well pumping can be done with either the dual piston downhole counterbalance unit of FIG. 18, the three piston downhole counterbalance unit of FIGS. 7–8, variations of the three piston downhole counterbalance unit as shown in FIGS. 9–11, as well as the dual power tube downhole unit of FIG. 17. In instances where several of the counterbalance piston assemblies are installed downhole in a plurality of wells (see FIGS. 19,22), any extra force provided during the resetting stroke for those wells coupled to one pulser piston helps to move the opposite pulser piston through its power stroke, and vice versa, thereby avoiding any waste of energy which might otherwise occur.

Figure 20:
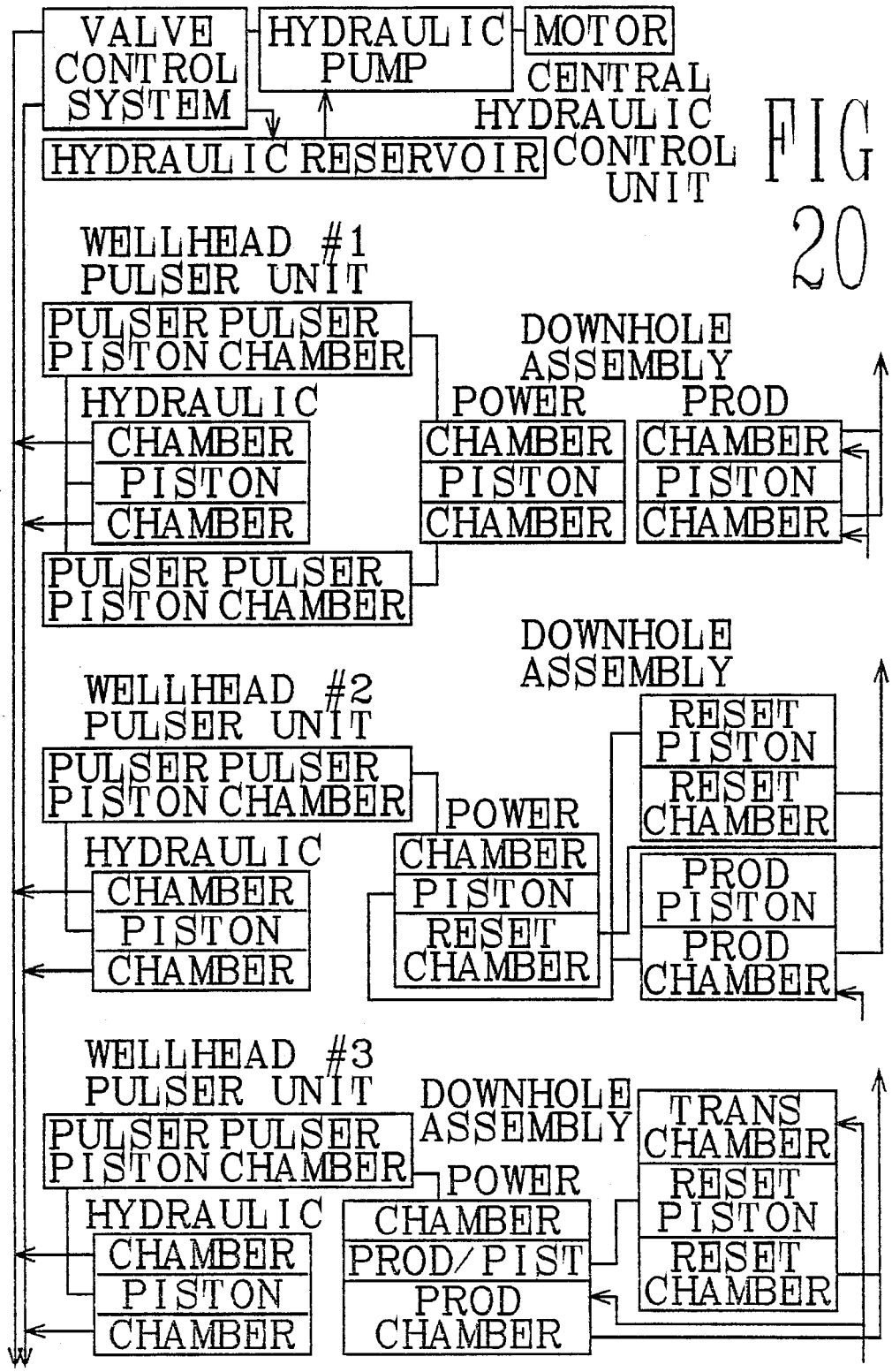
FIG. 20 is a schematic block diagram showing multiple well installations with a separate pulser unit for each wellhead.

In such a multiple well installation, it is necessary to have only a single power tube connecting the centrally located hydraulic actuator unit with each counterbalance downhole piston assembly, and only two power tubes connecting the central hydraulic actuator unit with a dual power tube downhole piston assembly. Also, the production tube outlet can be routed to any desirable location either close to or separate and apart from the centrally located hydraulic actuator unit. Of course, it will be understood that these production tube lines and power tube lines can be located along the ground or under the ground to make the wellhead virtually hidden from view as well as allowing normal land use by people, vehicles, or the like without the usual ugly and bulky pump jack apparatus which has blighted urban and rural environments for many years.

Where desirable, it is also possible to mount the pulser displacement cylinder adjacent to each well (see FIG. 20) and provide two hydraulic supply lines (and preferably a hydraulic primer line) connected from a central hydraulic reservoir and pump/motor installation. The pulser displacement cylinder can be mounted in horizontal position above the wellhead (see FIG. 7) or inserted down into the wellhead (see FIG. 1). thus, the present invention provides many choices and combinations of components, depending upon visual and space considerations, type and depth of well, expected flow rate, as well as the purchase price, ease and expense of installation, maintenance accessibility and cost, and energy consumption, all within the spirit of the invention.

It will be appreciated that the method and apparatus of the present invention provides a substantive improvement over the existing types of pump currently in use, such as pumpjack/suckerrod units, electric submersible pumps, conventional hydraulic pumps, and gas lifts. In other words, the product of this invention will result in lower purchase price, lower maintenance expense, increased durability, energy savings, compact size, and lower overall lifting cost over competing products in the market.

Figure 14:
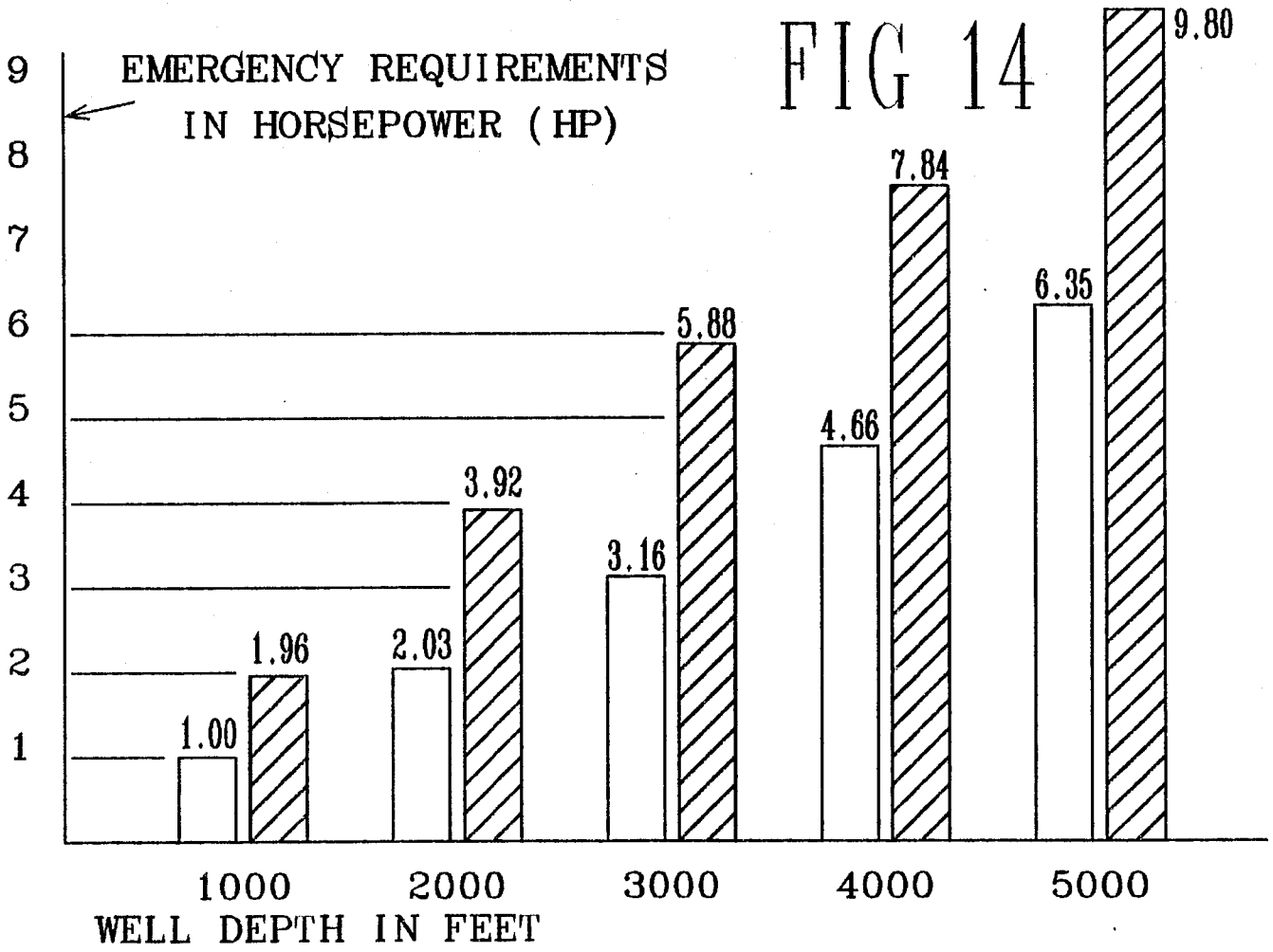
FIG. 14 is a graphical representation of the estimated energy savings at 100 BPD flowrate of a well installation using the embodiment of FIG. 12.

The experimental work which led us to the development of the present invention includes many documented field tests. From these tests the power requirements of the invention have been calculated to be significantly less than other pumps, as shown in FIGS. 13,14. This is accomplished without the use of any springs, which have a history of fatigue failures and are difficult to manufacture for deeper well depths.

Moreover, the use of a hydraulic control system without the usual electrical or mechanical components provides a very satisfactory means for operating the pulser displacement unit at the top of the well. Maintenance life of the hydraulic sytem depends primarily on two factors: cleanliness of the hydraulic fluid, and suitable temperature of the hydraulic fluid. To insure the cleanliness of the hydraulic fluid, a low micron filter on the hydraulic pump outlet is equipped with a so-called dirt alarm that warns the operator that another low cost filter needs to be installed. To keep the hydraulic fluid temperature down to acceptable levels, the produced fluid from the formation (usually at approximately 55-65 degrees F.) is circulated through a heat exchanger inside the hydraulic fluid reservoir. This has proved to be a very adequate means of reducing hydraulic fluid temperature on the experimental prototypes. By using pressure activated hydraulic sequence valves instead of electrical pressure switches, greater reliability has been achieved. Every component in the switching system is lubricated by the hydraulic fluid to insure long component life. Moreover, the pressure sensitive sequence valves can be easily adjusted to vary the pulser stroke length to accomodate varying well conditions.

Thus, the end result is a viable well pump that has a minimum of working parts and requres a relatively low power input when compared to the amount of production delivered.

While specific exemplary embodiments of the invention have been illustrated and described, it will be appreciated by those skilled in the art that various changes and modifications can be made without departing from the scope of the invention as set forth in the attached claims.

We claim as our invention:

1. Pumping apparatus having a power stroke and a reset stroke for removing source fluid from a source location to a higher collection location, comprising:

hydraulic pump means for providing the hydraulic pressure during the power stroke for actuating the pumping apparatus;

power tube means extending from the hydraulic pump means to the source location and containing hydraulic power fluid for transferring power from the hydraulic pump means to the source location during the power stroke;

hydraulic reset means for resetting the pumping apparatus during the reset stroke;

pulser means positioned at the power end of the power tube means, having a pump end and a tube end;

pulser fluid within the pump end of the pulser means pressurized by the hydraulic pump means;

pulser reciprocating means slidably positioned within the pulser means for movement in a power direction from the pump end to the tube end during the power stroke in response to the hydraulic pump means for transferring the hydraulic pressure provided by the hydraulic pump means to the power tube means, and movement in the opposite reset direction from the tube end to the pump end during the reset stroke;

hydraulic face on the pulser reciprocating means disposed toward the pump end of the pulser means;

pulser face on the pulser reciprocating means disposed toward the tube end of the pulser means;

hydraulic power chamber formed by the hydraulic face of the pulser reciprocating means and the pump end of the pulser means, and in fluid communication with the hydraulic pump means for receiving pulser fluid from the hydraulic pump means and expanding during the power stroke;

control valve means having a power state and a reset state, connected between the pump means and the hydraulic power chamber when in the power state for permitting the pump means to pressurize the hydraulic power chamber during the power stroke, and connected between the pump means and the hydraulic reset chamber when in the reset state to pressurize the hydraulic reset chamber during the reset stroke;

power pilot valve means responsive to the pressure within the hydraulic power chamber for switching the control valve means from the power state to the reset state at the end of each power stroke;

reset pilot valve means responsive to the pressure within the hydraulic reset chamber for switching the control valve means from the reset state to the power state at the end of each reset stroke;

pulser chamber formed by the pulser face of the pulser reciprocating means and the tube end of the pulser means, and in fluid communication with the power tube means for contracting during the power stroke forcing power fluid into the power tube means; and source tube means extending from the source location up to the collection location for conduiting source fluid up to the collection location during the power stroke;

chamber means positioned at the source end of the power tube means and formed by a power section having a power end and a reset end and by a pump section having a transfer end and a pump end;

chamber reciprocating means slidably positioned within the chamber means for movement in a power direction from a power position to a reset position during the power stroke in response to the hydraulic pump means, and movement in the opposite reset direction from the reset position to the power position during the reset stroke in response to the hydraulic reset means;

power piston means formed on the chamber reciprocating means within the power section of the chamber means, having a power face and a reset face;

pump piston means formed on the chamber reciprocating means within the pump section of the chamber means, having a transfer face and a pump face;

a power chamber formed by the power face of the power piston means and the power end of the power section and in fluid communication with the power tube means, the power chamber expands during the power stroke in response to the hydraulic pressure provided by the hydraulic pump means and contracts during the reset stroke;

a power reset chamber formed by the reset face of the power piston means and the reset end of the power section and in fluid communication with the hydraulic reset means, the power reset chamber contracts during the power stroke in response to the expanding power chamber and expands during the reset stroke in response to the hydraulic reset means;

a pump transfer chamber formed by the transfer face of the pump piston means and the transfer end of the pump section, which expands during the power stroke and contracts during the reset stroke;

a transfer port between the pump transfer chamber and the source fluid in the source location for extablishing fluid communication therebetween which permits the transfer chamber to fill with source fluid during the power stroke when the pump transfer chamber is expanding and which permits the pump transfer chamber to return the source fluid to the source location during the reset stroke when the pump transfer chamber is contracting;

a pump chamber formed by the pump face of the pump piston means and the pump end of the power section, which contracts during the power stroke and expends during the reset stroke;

pump valve means between the pump chamber and the source tube means for permitting the flow of source fluid from the pump chamber into the source tube means during the power stroke, and for preventing the return flow of source fluid from the source tube means into the pump chamber during the reset stroke; and reset valve means between the pump chamber and the source location for permitting the flow of source fluid from the source location into the pump chamber during the reset stroke, and for preventing the return flow of source fluid from the pump chamber into the source location during the reset stroke.

2. The pumping apparatus of claim 1, wherein the hydraulic power means further comprises a pulser fluid reservoir means connected to the hydraulic pump means for providing pulser fluid to the hydraulic pump means.

3. The pumping apparatus of claim 2, wherein the pulser fluid reservoir means further comprises a heat exchanger means in fluid communication with the source tube means for transferring heat from the pulser fluid to the source fluid.

4. The pumping apparatus of claim 1, wherein the hydraulic power means further comprises:

coupler means within the pulser means between the pump end and the tube end thereof;

pump piston including the pump face formed on the pulser reciprocating means within the hydraulic power chamber disposed toward the pump end thereof;

pulser piston including the pulser face formed on the pulser reciprocating means within the pulser chamber disposed toward the tube end thereof;

rigid connecting means between the pump piston and the pulser piston extending through the coupler means;

hydraulic reset face on the pump piston disposed toward the coupler means; and hydraulic reset chamber formed by the reset face and the coupling means.

5. The pumping apparatus of claim 4, wherein the pulser means further comprises:

isolation face on the pulser piston disposed toward the coupler means; and isolation chamber formed by the isolation face of the pulser piston and the coupling means for maintaining separation of the pump fluid and the power fluid.

6. The pumping apparatus of claim 5, wherein the isolation chamber further comprises a vent means.

7. Pumping apparatus having a power stroke and a reset stroke for removing source fluid from a source location to a higher collection location, comprising:

hydraulic power means for providing hydraulic pressure during the power stroke for actuating the pumping apparatus;

power tube means extending from the hydraulic power means to the source location and containing hydraulic power fluid for transferring power from the hydraulic power means to the source location during the power stroke;

hydraulic reset means for resetting the pumping apparatus during the reset stroke;

source tube means extending from the source location up to the collection location for conduiting source fluid up to the collection location during power stroke;

chamber means positioned at the source end of the power tube means and formed by a power section having a power end and a reset end and by a pump section having a transfer end and a pump end;

chamber reciprocating means slidably positioned within the chamber means for movement in a power direction from a power position to a reset position during the power stroke in response to the hydraulic power means, and movement in the opposite reset direction from the reset position to the power position during the reset stroke in response to the hydraulic reset means;

power piston means formed on the chamber reciprocating means within the power section of the chamber means, having a power face and a reset face;

pump piston means formed on the chamber reciprocating means within the pump section of the chamber means, having a transfer face and a pump face;

a power chamber formed by the power face of the power piston means and the power end of the power section and in fluid communication with the power tube means, the power chamber receives power fluid to expand during the power stroke in response to the hydraulic pressure provided by the hydraulic power means and expels power fluid to contract during the reset stroke;

a power reset chamber formed by the reset face of the power piston means and the reset end of the power section and in fluid communication with the hydraulic reset means, the power reset chamber contracts during the power stroke in response to the expanding power chamber and expands during the reset stroke in response to the hydraulic reset means;

a pump transfer chamber formed by the transfer face of the pump piston means and the transfer end of the pump section, which expands during the power stroke and contracts during the reset stroke;

a transfer port between the pump transfer chamber and the source fluid in the source location for establishing fluid communication therebetween which permits the transfer chamber to fill with source fluid during the power stroke when the pump transfer chamber is expanding and which permits the pump transfer chamber to return the source fluid to the source location during the reset stroke when the pump transfer chamber is contracting;

a pump chamber formed by the pump face of the pump piston means and the pump end of the power section, which contracts during the power stroke and expands during the reset stroke;

pump valve means between the pump chamber and the source tube means for permitting the flow of source fluid from the pump chamber into the source tube means during the power stroke, and for preventing the return flow of source fluid from the source tube means into the pump chamber during the reset stroke; and reset valve means between the pump chamber and the source location for permitting the flow of source fluid from the source location into the pump chamber during the reset stroke, and for preventing the return flow of source fluid from the pump chamber into the source location during the reset stroke.

8. The pumping apparatus of claim 7, wherein the valve means of the pump chamber are check valve means.

9. The pumping apparatus of claim 7, further comprising a power fluid primer means formed by:

primer line means extending between the source tube means and the power tube means;

primer valve means in the primer line means for permitting source fluid to pass from the source tube means into the power tube means during the reset stroke to maintain the fluid level in the power tube means.

10. The pumping apparatus of claim 7, wherein the power fluid within the power tube means is maintained separate from the source fluid in the chamber means.

11. The pumping apparatus of claim 7, wherein the hydraulic reset means is the static pressure of the weight of the column of source fluid in the source tube means extending up the source tube from the source location to the collection location, and is the active force in returning the chamber reciprocating means from the reset position to the power position during the reset stroke.

12. The pumping apparatus of claim 11, wherein the pump section of the chamber means has a larger cross-section than the power section of the chamber means, and the pump piston within the pump section has a larger cross-section than the power piston within the power section, for augmenting the static pressure of the source fluid in the source tube means to overcome the static pressure of the power fluid in the power tube means during the reset stroke and returning the chamber reciprocating means to the power position.

13. The pumping apparatus of claim 11, further comprising:

a counterbalance section in the chamber means having a transfer end and a reset end;

a counterbalance piston means formed on the chamber reciprocating means positioned within the counterbalance section of the chamber means and having a transfer face and a reset face;

a counterbalance transfer chamber formed by the transfer face of the counterbalance piston means and the transfer end of the counterbalance section, which expands during the power stroke and contracts during the reset stroke and;

a counterbalance reset chamber formed by the reset face of the counterbalance piston means and the reset end of the counterbalance section and in fluid communication with the source fluid in the source tube, the counterbalance reset chamber contracts during the power stroke in response to the expanding power chamber and expands during the reset stroke in response to the static pressure of the column of source fluid.

14. The pumping apparatus of claim 13, wherein the combined area of the reset face on the pump piston means and the area of the reset face on the counterbalance piston means is greater than the area of the reset face on the power piston means.

15. The pumping apparatus of claim 13, wherein the chamber means extends vertically into the source location with the power section on top and the pump section on the bottom and the counterbalance section in the middle.

16. The pumping apparatus of claim 15, wherein the chamber reciprocating means moves downward during the power stroke and upward during the reset stroke.

17. The pumping apparatus of claim 13, further comprising a transfer port between the counterbalance transfer chamber and the source fluid in the source location for establishing fluid communication therebetween which permits the counterbalance transfer chamber to fill with source fluid during the power stroke when the transfer chamber is expanding and which permits the transfer chamber to return the source fluid to the source location during the reset stroke when the transfer chamber is contracting.

18. The pumping apparatus of claim 17, wherein the chamber reciprocating means further comprises a piston connection means extending between the power piston means and the counterbalance piston means and the pump piston means.

19. The pumping apparatus of claim 18, wherein the piston connection means is a hollow shaft with one end in fluid communication with the source fluid in the source location, and the transfer ports in the pump transfer chamber and the counterbalance transfer chamber are aperture means in the hollow shaft for transferring the source fluid.

20. The pumping apparatus of claim 7, wherein the reset stroke is an alternate power stroke and the reset direction is an alternate power direction, and the hydraulic power means further comprises;

hydraulic pump means for providing the hydraulic pressure in the power tube means during the power stroke and the alternate power stroke;

pulser means positioned at the power end of the power tube means, having a power section and an alternate power section with a central pump section therebetween;

pulser fluid within the central pump section pressurized by the hydraulic pump means;

pulser reciprocating means slideably positioned within the pulser means for movement in the power direction during the power stroke and movement in the opposite alternate power direction during the alternate power stroke;

pump piston formed on the pulser reciprocating means within the central pump section, having a hydraulic face responsive to the hydraulic pump means for moving the reciprocating means in the power directin and having an alternate hydraulic face responsive to the hydraulic pump means for moving the reciprocating means in the alternate power direction;

pulser piston formed on the pulser reciprocating means within the power section, having a pulser face disposed toward the power section;

pulser chamber formed by the pulser face and the power section and in fluid communication with the power tube means for contracting during the power stroke forcing power fluid into the power tube;

alternate pulser piston formed on the pulser reciprocating means within the alternate power section having an alternate pulser face disposed toward the alternate power section;

alternate pulser chamber formed by the alternate pulser face and the alternate power section and in fluid communication with the power tube means for contracting during the alternate power stroke forcing power fluid into the power tube; and pulser valve means for directing the pump fluid from the hydraulic pump means into the power chamber during the power stroke and into the alternate power chamber during the alternate power stroke.

21. The pumping apparatus of claim 20, wherein the power tube means comprises a power tube which is pressurized during the power stroke and an alternate power tube which is pressurized during the alternate power stroke.

22. The pumping apparatus of claim 21, wherein the power tube is in fluid communication with the power chamber for expanding the power chamber during the power stroke, and the alternate power tube is in fluid communication with the reset chamber for expanding the reset chamber during the alternate power stroke.

23. The pumping apparatus of claim 22, wherein the source location is an oil formation and the source fluid is production fluid and the source tube means is a well casing.

24. The pumping apparatus of claim 23, wherein the power tube and the alternate power tube are concentric tubes within the well casing source tube.

25. The pumping apparatus of claim 23, wherein the power tube and the alternate power tube are separate tubes within the well casing source tube.

* * * * *